US008280557B2

(12) United States Patent
Kawano et al.

(10) Patent No.: US 8,280,557 B2
(45) Date of Patent: Oct. 2, 2012

(54) AIR-CONDITIONING APPARATUS

(75) Inventors: Satoshi Kawano, Sakai (JP); Masahiro Oka, Sakai (JP); Kazuhiko Tani, Sakai (JP); Atsushi Okamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 395 days.

(21) Appl. No.: 12/601,708

(22) PCT Filed: May 27, 2008

(86) PCT No.: PCT/JP2008/059686

§ 371 (c)(1),
(2), (4) Date: Nov. 24, 2009

(87) PCT Pub. No.: WO2008/149715

PCT Pub. Date: Dec. 11, 2008

(65) Prior Publication Data

US 2010/0198415 A1 Aug. 5, 2010

(30) Foreign Application Priority Data

May 30, 2007 (JP) ..... 2007-143815
May 20, 2008 (JP) ..... 2008-131874

(51) Int. Cl.

| | |
|---|---|
| ***F25B 13/00*** | (2006.01) |
| ***G05D 17/00*** | (2006.01) |
| ***G05D 11/00*** | (2006.01) |
| *G05B 19/18* | (2006.01) |
| *G06F 19/00* | (2006.01) |

(52) U.S. Cl. ..... 700/282; 62/3.3; 62/50.6; 62/118; 62/324.1; 700/295

(58) Field of Classification Search ..... 62/324.1, 62/3.3, 50.6, 118; 700/282, 295
See application file for complete search history.

(56) References Cited

U.S. PATENT DOCUMENTS 5,361,595 A 11/1994 Shimura et al.
7,542,824 B2 * 6/2009 Miki et al. ..... 700/291
7,607,317 B2 * 10/2009 Honda et al. ..... 62/324.1
(Continued)

FOREIGN PATENT DOCUMENTS

JP 02-217737 A 8/1990
(Continued)

OTHER PUBLICATIONS

Office Action of corresponding Korean Application No. 2009-702514316 dated Aug. 2, 2011, 4 paqes.

*Primary Examiner* — Charles Kasenge
*Assistant Examiner* — Thomas Stevens
(74) *Attorney, Agent, or Firm* — Global IP Counselors

(57) ABSTRACT

An air-conditioning apparatus includes first and second outdoor units having first and second outdoor heat exchangers and first and second heat source-side degree of subcooling adjustment devices configured to adjust first and second degrees of subcooling in outlet sides of the first and second outdoor heat exchangers, respectively. First and second outdoor-side determination units are configured to determine first and second degrees of subcooling, respectively. A controller is configured to control the first and second heat source-side degree of subcooling adjustment devices, respectively, such that a difference between the first degree of subcooling and the second degree of subcooling is reduced when refrigerant is charged into a refrigerant circuit having the first outdoor heat exchanger and the second outdoor heat exchanger.

20 Claims, 12 Drawing Sheets

U.S. PATENT DOCUMENTS 8,047,011 B2 * 11/2011 Kawano et al. ..... 62/160

FOREIGN PATENT DOCUMENTS

| | | | |
|---|---|---|---|
| JP | 04-283361 | A | 10/1992 |
| JP | 05-288422 | A | 11/1993 |
| JP | 9-196490 | A | 7/1997 |
| JP | 10-078264 | A | 3/1998 |
| JP | 11-142010 | A | 5/1999 |
| JP | 2001-208441 | A | 8/2001 |
| JP | 2002-054836 | A | 2/2002 |
| JP | 2002-295912 | A | 10/2002 |
| JP | 2006-023072 | A | 1/2006 |
| JP | 2006-058007 | A | 3/2006 |
| JP | 2007-107860 | A | 4/2007 |

* cited by examiner

AIR-CONDITIONING APPARATUS

CROSS-REFERENCE TO RELATED APPLICATIONS

This U.S. National stage application claims priority under 35 U.S.C. §119(a) to Japanese Patent Application Nos. 2007-143815, filed in Japan on May 30, 2007, and 2008-131874, filed in Japan on May 20, 2008, the entire contents of which are hereby incorporated herein by reference.

TECHNICAL FIELD

The present invention relates to an air-conditioning apparatus comprising a plurality of heat source units.

BACKGROUND ART

In conventional practice, there are air-conditioning apparatuses comprising a heat source unit, a usage unit, and a communication pipe for connecting the heat source unit and the usage unit. With this type of air-conditioning apparatus, a method is used in which the heat source unit is charged in advance with a predetermined amount of refrigerant, and when the apparatus is installed on site, it is charged with an additional amount of refrigerant according to the length of the communication pipe connecting the heat source unit and the usage unit. However, since the length of the refrigerant pipe differs depending on the conditions of installing the air-conditioning apparatus at the installation site, there have been cases in which it is difficult to charge the refrigerant circuit with an appropriate amount of refrigerant.

In view of this, an operation has been proposed in which, when the refrigerant circuit is additionally charged with refrigerant, the amount thereof is determined according to the degree of subcooling of the refrigerant in the outlet of a heat source-side heat exchanger functioning as a condenser while the usage unit is set to the cooling operation, and the refrigerant continues to be charged until the degree of subcooling reaches a predetermined value (Japanese Laid-open Patent Application No. 2006-23072, for example).

SUMMARY OF THE INVENTION

Technical Problem

However, in an air-conditioning apparatus comprising a plurality of heat source units, when the refrigerant circuit is charged with the refrigerant, there are occasions in which the refrigerant drifts due to the installment conditions of the heat source units, the temperature conditions, and other conditions; and the degrees of subcooling in the outlets of the heat source-side heat exchangers become disproportionate. Therefore, when the amount of refrigerant charged in the refrigerant circuit is determined according to the degrees of subcooling of the refrigerant in the outlets of the heat source-side heat exchangers, there is a danger of reducing the accuracy of this determined.

An object of the present invention is to improve the precision of determining the amount of refrigerant charged in the refrigerant circuit when the refrigerant circuit is charged with refrigerant in an air-conditioning apparatus comprising a plurality of heat source units.

Solution to Problem

An air-conditioning apparatus according to a first aspect of the present invention comprises a first heat source unit, a second heat source unit, a first determination unit, a second determination unit, and a controller. The first heat source unit includes a first heat source-side heat exchanger and first heat source-side degree of subcooling adjustment device (means). The first heat source-side heat exchanger functions at least as a condenser, and the first heat source-side degree of subcooling adjustment means adjusts a first degree of subcooling in an outlet side of the first heat source-side heat exchanger. The second heat source unit includes a second heat source-side heat exchanger and second heat source-side degree of subcooling adjustment device (means). The second heat source-side heat exchanger functions at least as a condenser, and the second heat source-side degree of subcooling adjustment means adjusts a second degree of subcooling in an outlet side of the second heat source-side heat exchanger. The first determination unit determines the first degree of subcooling. The second determination unit determines the second degree of subcooling. The controller controls the first heat source-side degree of subcooling adjustment means and the second heat source-side degree of subcooling adjustment means so as to reduce the difference between the first degree of subcooling and the second degree of subcooling when refrigerant is charged into a refrigerant circuit having the first heat source-side heat exchanger and the second heat source-side heat exchanger.

The air-conditioning apparatus according to the first aspect comprises a controller for controlling the first heat source-side degree of subcooling adjustment means and the second heat source-side degree of subcooling adjustment means. The controller controls the first heat source-side degree of subcooling adjustment means and the second heat source-side degree of subcooling adjustment means so as to reduce the difference between the first degree of subcooling and the second degree of subcooling. For example, in cases in which the amount of refrigerant flowing through the first heat source-side heat exchanger is adjusted by the first heat source-side degree of subcooling adjustment means and the amount of refrigerant flowing through the second heat source-side heat exchanger is adjusted by the second heat source-side degree of subcooling adjustment means, the controller controls the first heat source-side degree of subcooling adjustment means and the second heat source-side degree of subcooling adjustment means so as to reduce the difference between the amount of refrigerant flowing through the first heat source-side heat exchanger and the amount of refrigerant flowing through the second heat source-side heat exchanger. Therefore, it is possible to inhibit refrigerant drift in the first heat source-side heat exchanger and the second heat source-side heat exchanger.

It is thereby possible to improve the precision of determining the amount of refrigerant charged into the refrigerant circuit when refrigerant is charged into the refrigerant circuit.

The reduction in the difference between the first degree of subcooling and second degree of subcooling referred to herein may refer to cases in which the difference between the first degree of subcooling and second degree of subcooling is equal to or less than a predetermined value, as well as cases in which the first degree of subcooling and the second degree of subcooling coincide.

The air-conditioning apparatus according to a second aspect of the present invention is the air-conditioning apparatus according to the first aspect, further comprising a first temperature sensor and a second temperature sensor. The first temperature sensor detects the temperature of refrigerant in the first heat source unit. The second temperature sensor detects the temperature of refrigerant in the second heat source unit. The first determination unit determines the first degree of subcooling on the basis of the temperature detected by the first temperature sensor. The second determination unit determines the second degree of subcooling on the basis of the temperature detected by the second temperature sensor. Therefore, the first determination unit and the second determination unit can calculate the first degree of subcooling and the second degree of subcooling from the temperature of the flowing refrigerant.

In the air-conditioning apparatus according to the second aspect, it is thereby possible to determine the degree of subcooling by a simple configuration.

The air-conditioning apparatus according to a third aspect of the present invention is the air-conditioning apparatus according to the first or second aspect, wherein the first heat source-side degree of subcooling adjustment means is a first heat source-side flow rate adjustment valve, and the second heat source-side degree of subcooling adjustment means is a second heat source-side flow rate adjustment valve. The controller sets the first heat source-side flow rate adjustment valve to a first opening degree and sets the opening degree of the second heat source-side flow rate adjustment valve to a second opening degree having a smaller opening than the first opening degree when the first degree of subcooling is greater than the second degree of subcooling.

In the air-conditioning apparatus according to the third aspect, the controller adjusts the opening degrees of the first heat source-side flow rate adjustment valve and the second heat source-side flow rate adjustment valve on the basis of the first degree of subcooling and the second degree of subcooling. For example, in cases in which the first degree of subcooling is greater than the second degree of subcooling, the difference between the amount of refrigerant flowing through the first heat source-side heat exchanger and the amount of refrigerant flowing through the second heat source-side heat exchanger is reduced by reducing the opening in the opening degree of the second heat source-side flow rate adjustment valve having the lower degree of subcooling to be smaller than the first opening degree. Therefore, it is possible to inhibit refrigerant drift in the first heat source-side heat exchanger and the second heat source-side heat exchanger.

In this air-conditioning apparatus, it is thereby possible to inhibit refrigerant drift by a simple configuration.

The air-conditioning apparatus according to a fourth aspect of the present invention is the air-conditioning apparatus according to any of the first through third aspects, wherein the controller determines the amount of refrigerant in the refrigerant circuit on the basis of either the first degree of subcooling or the second degree of subcooling. In this air-conditioning apparatus, since the difference between the amounts of refrigerant flowing through the first heat source-side heat exchanger and the second heat source-side heat exchanger is controlled by the controller so as to decrease, the difference between the first degree of subcooling and the second degree of subcooling decreases. Therefore, the amount of refrigerant charged into the refrigerant circuit can be determined from the degree of subcooling in the outlet of either one of the installed heat source-side heat exchangers.

The amount of refrigerant charged into the refrigerant circuit can thereby be easily determined.

The air-conditioning apparatus according to a fifth aspect of the present invention is the air-conditioning apparatus according to any of the first through fourth aspects, further comprising a usage unit having a usage-side heat exchanger and a usage-side flow rate adjustment mechanism. The usage-side heat exchanger functions at least as an evaporator. The usage-side flow rate adjustment mechanism adjusts the flow rate of refrigerant flowing through the usage-side heat exchanger. The refrigerant circuit further has the usage-side heat exchanger and the usage-side flow rate adjustment mechanism. The controller controls the usage-side flow rate adjustment mechanism so that the degree of superheat in the outlet side of the usage-side heat exchanger reaches a predetermined value when refrigerant is charged into the refrigerant circuit.

With the air-conditioning apparatus according to the fifth aspect, the opening degree of the usage-side flow rate adjustment mechanism is adjusted based on the degree of superheat in the outlet side of the usage-side heat exchanger when refrigerant is charged into the refrigerant circuit. Therefore, the amount of refrigerant flowing to the usage-side heat exchanger can be adjusted. Consequently, the amount of refrigerant flowing through the usage-side heat exchanger can be kept constant.

It is thereby possible to improve the precision of determining the amount of refrigerant charged into the refrigerant circuit when refrigerant is charged into the refrigerant circuit.

The air-conditioning apparatus according to a sixth aspect of the present invention comprises first through n-th heat source units, first through n-th determination units, and a controller. The first through n-th heat source units have first through n-th heat source-side heat exchangers and first through n-th heat source-side flow rate adjustment devices (means). The first through n-th heat source-side heat exchangers function at least as condensers. The first through n-th heat source-side flow rate adjustment means adjust the flow rate of refrigerant flowing through the first through n-th heat source-side heat exchangers. The first through n-th determination units determine first through n-th degrees of subcooling in outlet sides of the first through n-th heat source-side heat exchangers. The controller controls the first through n-th heat source-side flow rate adjustment means so that the first through n-th degrees of subcooling come to be equal when refrigerant is charged into a refrigerant circuit having the first through n-th heat source-side heat exchangers and the first through n-th heat source-side flow rate adjustment means.

The air-conditioning apparatus according to the sixth aspect of the present invention comprises a controller for controlling the first through n-th heat source-side flow rate adjustment means. The control controls all of the first through n-th heat source-side flow rate adjustment means so that the first through n-th degrees of subcooling come to be equal. Therefore, the amounts of refrigerant flowing through the first through n-th heat source-side heat exchangers come to be equal. Consequently, refrigerant drift does not readily occur in all of the first through n-th heat source-side heat exchangers.

It is thereby possible to improve the precision of determining the amount of refrigerant charged into the refrigerant circuit when refrigerant is charged into the refrigerant circuit.

The air-conditioning apparatus according to a seven-th aspect of the present invention is the air-conditioning apparatus according to the sixth aspect, wherein the first through n-th heat source-side flow rate adjustment means are first through n-th heat source-side flow rate adjustment valves. The controller sets the first heat source-side flow rate adjustment valve to a first opening degree and sets the opening degrees of the second through n-th heat source-side flow rate adjustment valves to opening degrees having smaller opening degrees than the first opening degree when the first degree of subcooling is greater than any of the second through n-th degrees of subcooling.

In the air-conditioning apparatus according to the seven-th aspect, the controller adjusts the opening degrees of the first through n-th heat source-side flow rate adjustment valves on the basis of the first through n-th degrees of subcooling. For example, in cases in which the first degree of subcooling is greater than any of the second through n-th degrees of subcooling, the openings in the opening degrees of the second through n-th heat source-side flow rate adjustment valves having lower degrees of subcooling are reduced to be smaller than the first opening degree, whereby the amount of refrigerant flowing through the first heat source-side heat exchanger and the amounts of refrigerant flowing through the second through n-th heat source-side heat exchangers come to be equal. Therefore, it is possible to inhibit refrigerant drift in the first through n-th heat source-side heat exchangers.

With this air-conditioning apparatus, it is thereby possible to inhibit refrigerant drift by a simple configuration.

The air-conditioning apparatus according to an eighth aspect of the present invention is the air-conditioning apparatus according to the first or second aspect, wherein the first heat source-side degree of subcooling adjustment means is a first compressor for compressing refrigerant flowing through the refrigerant circuit. The second heat source-side degree of subcooling adjustment means is a second compressor for compressing refrigerant flowing through the refrigerant circuit. Furthermore, the controller controls the first compressor and the second compressor so that the rotational speed of the first compressor is less than the rotational speed of the second compressor when the first degree of subcooling is greater than the second degree of subcooling.

In the air-conditioning apparatus according to the eighth aspect, the controller adjusts the rotational speeds of the first compressor and second compressor on the basis of the first degree of subcooling and the second degree of subcooling. For example, in cases in which the first degree of subcooling is greater than the second degree of subcooling, the difference between the amount of refrigerant flowing through the first heat source-side heat exchanger and the amount of refrigerant flowing through the second heat source-side heat exchanger can be reduced by increasing the rotational speed of the second compressor having the lower degree of subcooling so that it will be greater than the rotational speed of the first compressor. Therefore, it is possible to inhibit refrigerant drift in the first heat source-side heat exchanger and the second heat source-side heat exchanger.

With this air-conditioning apparatus, it is thereby possible to inhibit refrigerant drift by a simple configuration.

The air-conditioning apparatus according to a nin-th aspect of the present invention is the air-conditioning apparatus according to the first or second aspect, wherein the first heat source-side degree of subcooling adjustment means is a first heat source-side fan for blowing air to the first heat source-side heat exchanger. The second heat source-side degree of subcooling adjustment means is a second heat source-side fan for blowing air to the second heat source-side heat exchanger. Furthermore, the controller controls the first heat source-side fan and the second heat source-side fan so that the rotational speed of the first heat source-side fan is greater than the rotational speed of the second heat source-side fan when the first degree of subcooling is greater than the second degree of subcooling.

In the air-conditioning apparatus according to the nin-th aspect, the controller adjusts the rotational speeds of the first heat source-side fan and the second heat source-side fan on the basis of the first degree of subcooling and the second degree of subcooling. For example, in cases in which the first degree of subcooling is greater than the second degree of subcooling, the difference between the first degree of subcooling and the second degree of subcooling can be reduced by increasing the rotational speed of the first heat source-side fan so that it will be greater than the rotational speed of the second heat source-side fan.

Advantageous Effects of Invention

With the air-conditioning apparatus according to the first aspect, it is possible to improve the precision of determining the amount of refrigerant charged into the refrigerant circuit when refrigerant is charged into the refrigerant circuit.

With the air-conditioning apparatus according to the second aspect, it is possible to determine the degree of subcooling using a simple configuration.

With the air-conditioning apparatus according to the third aspect, it is possible to inhibit refrigerant drift using a simple configuration.

With the air-conditioning apparatus according to the fourth aspect, the amount of refrigerant charged into the refrigerant circuit can be easily determined.

With the air-conditioning apparatus according to the fifth aspect, it is possible to improve the precision of determining the amount of refrigerant charged into the refrigerant circuit when refrigerant is charged into the refrigerant circuit.

With the air-conditioning apparatus according to the sixth aspect, it is possible to improve the precision of determining the amount of refrigerant charged into the refrigerant circuit when refrigerant is charged into the refrigerant circuit.

With the air-conditioning apparatus according to the seventh aspect, it is possible to inhibit refrigerant drift by a simple configuration.

With the air-conditioning apparatus according to the eighth aspect, it is possible to inhibit refrigerant drift by a simple configuration.

With the air-conditioning apparatus according to the nin-th aspect, it is possible to reduce the difference between the first degree of subcooling and the second degree of subcooling.

DETAILED DESCRIPTION OF THE INVENTION

Figure 1:
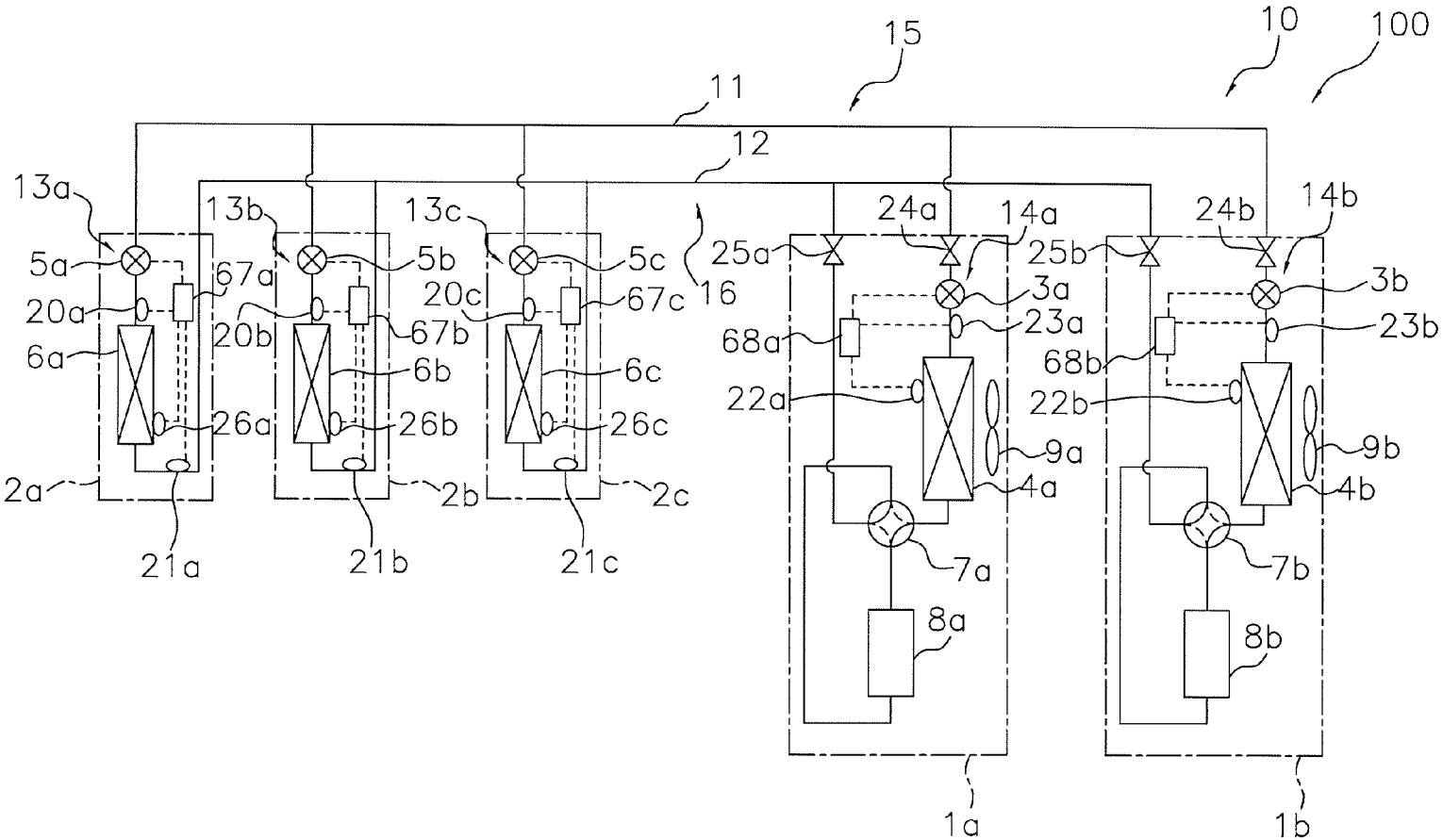
FIG. 1 is a schematic diagram of a refrigerant circuit of an air-conditioning apparatus according to an embodiment of the present invention.

A schematic diagram of a refrigerant circuit of an air-conditioning apparatus 100 according to an embodiment of the present invention is shown in FIG. 1. The air-conditioning apparatus 100 is an apparatus used to cool and heat a room interior in a building or the like by performing a vapor compression refrigeration cycle operation. The air-conditioning apparatus 100 primarily comprises two outdoor units 1*a*, 1*b*, three indoor units 2*a*, 2*b*, 2*c* connected in parallel to the outdoor units 1*a*, 1*b*, and refrigerant communication pipes for connecting the outdoor units 1*a*, 1*b* and the indoor units 2*a*, 2*b*, 2*c*. The refrigerant communication pipes are configured from a liquid refrigerant communication pipe 11 and a gas refrigerant communication pipe 12. Specifically, the liquid refrigerant communication pipe 11 and the gas refrigerant communication pipe 12 are connected to outdoor-side refrigerant circuits 14*a*, 14*b* of the outdoor units 1*a*, 1*b* and indoor-side refrigerant circuits 13*a*, 13*b*, 13*c* of the indoor units 2*a*, 2*b*, 2*c*. Specifically, a refrigerant circuit 10 of the air-conditioning apparatus 100 is configured by connecting the outdoor-side refrigerant circuits 14*a*, 14*b*, the indoor-side refrigerant circuits 13*a*, 13*b*, 13*c*, the liquid refrigerant communication pipe 11, and the gas refrigerant communication pipe 12. In the refrigerant circuit 10, a liquid refrigerant pipe 15 refers to a pipe through which passes refrigerant flowing from a heat exchanger functioning as a condenser to a heat exchanger functioning as an evaporator, and a gas refrigerant pipe 16 refers to a pipe through which passes refrigerant flowing from a heat exchanger functioning as an evaporator to a heat exchanger functioning as a condenser. Hereinbelow, among the various devices provided to the hereinafter-described refrigerant circuit 10, the sides connected to the liquid refrigerant pipe 15 are referred to as the liquid sides of the various devices, and the sides connected to the gas refrigerant pipe 16 are referred to as the gas sides of the various devices.

<Indoor Units>

The first indoor unit 2*a*, the second indoor unit 2*b*, and the third indoor unit 2*c* are embedded in or suspended from a ceiling of a room interior in a building or the like, or hung on the surface of a wall of a room interior. The first indoor unit 2*a*, the second indoor unit 2*b*, and the third indoor unit 2*c* are connected to the first outdoor unit 1*a* and the second outdoor unit 1*b* via the liquid refrigerant communication pipe 11 and the gas refrigerant communication pipe 12, constituting part of the refrigerant circuit 10.

Next, the configuration of the first indoor unit 2*a* will be described. The first indoor unit 2*a* has the same configuration as the second indoor unit 2*b* and the third indoor unit 2*c*, and therefore only the configuration of the first indoor unit 2*a* shall be described.

The first indoor unit 2*a* comprises primarily a first indoor expansion valve 5*a*, a first indoor heat exchanger 6*a*, a first indoor heat exchange liquid-side temperature sensor 20*a*, a first indoor heat exchange gas-side temperature sensor 21*a*, and a first indoor heat exchange temperature sensor 26*a*. A first indoor-side refrigerant circuit 13*a* as part of the refrigerant circuit 10 is configured by connecting the first indoor expansion valve 5*a* and the first indoor heat exchanger 6*a* using a refrigerant pipe.

The first indoor expansion valve 5*a* is an electric expansion valve connected to the liquid side of the first indoor heat exchanger 6*a* in order to adjust the amount of refrigerant flowing through the first indoor-side refrigerant circuit 13*a* and to perform other functions.

The first indoor heat exchanger 6*a* is a cross-fin type fin-and-pipe heat exchanger configured from a heat-transfer pipe and numerous fins. The first indoor heat exchanger 6*a* functions as a refrigerant evaporator during the cooling operation to cool air in the room interior, and functions as a refrigerant condenser during the heating operation to heat air in the room interior.

The first indoor heat exchange liquid-side temperature sensor 20*a* is provided to the liquid side of the first indoor heat exchanger 6*a*, and this sensor detects the temperature of refrigerant in a liquid state or a gas-liquid two-phase state. The first indoor heat exchange gas-side temperature sensor 21*a* is provided to the gas side of the first indoor heat exchanger 6*a*, and this sensor detects the temperature of the refrigerant in a gas state or a gas-liquid two-phase state. The first indoor heat exchange temperature sensor 26*a* is provided to the first indoor heat exchanger 6*a*, and this sensor detects the temperature of refrigerant flowing through the first indoor heat exchanger 6*a*. In the present embodiment, the first indoor heat exchange liquid-side temperature sensor 20*a*, the first indoor heat exchange gas-side temperature sensor 21*a*, and the first indoor heat exchange temperature sensor 26*a* are composed of thermistors.

Figure 2:
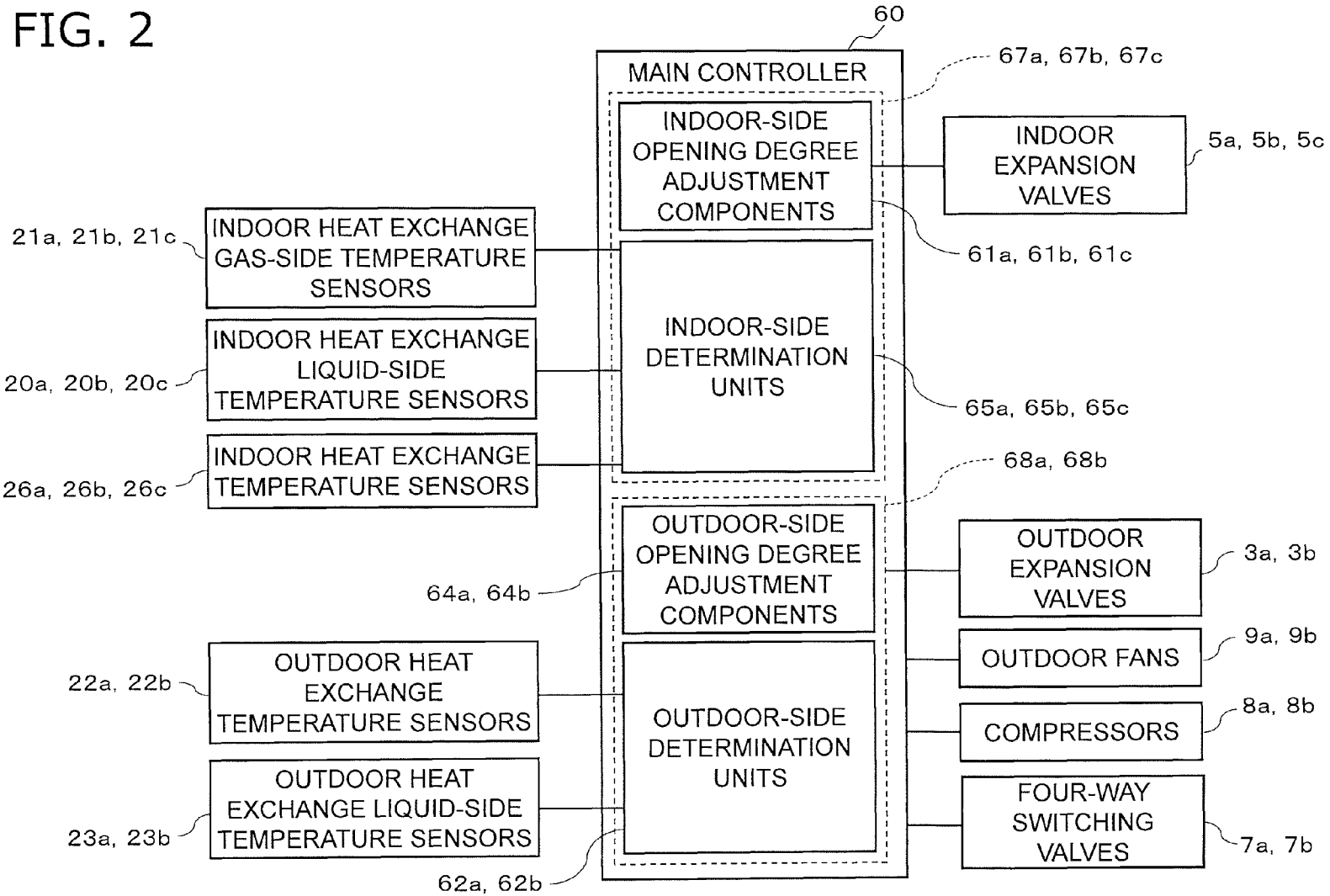
FIG. 2 is a control block diagram of the air-conditioning apparatus according to an embodiment of the present invention.

The first indoor unit 2*a* comprises a first indoor-side controller 67*a* for controlling the various devices and valves of the first indoor unit 2*a*, as shown in FIG. 2. The first indoor-side controller 67*a* has a first indoor-side determination unit 65*a* and a first indoor-side opening degree adjustment component 61*a*. The second indoor unit 2*h* comprises a second indoor-side controller 67*b* for controlling the various devices and valves of the second indoor unit 2*b*, as shown in FIG. 2. The second indoor-side controller 67*b* has a second indoor-side determination unit 65*b* and a second indoor-side opening degree adjustment component 61*b*. The third indoor unit 2*c* comprises a third indoor-side controller 67*c* for controlling the various devices and valves of the third indoor unit 2*c*, as shown in FIG. 2. The third indoor-side controller 67*c* has a third indoor-side determination unit 65*c* and a third indoor-side opening degree adjustment component 61*c*. Based on the refrigerant temperatures detected by the first indoor heat exchange liquid-side temperature sensor 20*a*, the first indoor heat exchange gas-side temperature sensor 21*a*, and the first indoor heat exchange temperature sensor 26*a*, the first indoor-side determination unit 65*a* calculates the degree of superheat when the first indoor heat exchanger 6*a* is functioning as an evaporator, and calculates the degree of subcooling when the first indoor heat exchanger 6*a* is functioning as a condenser. The first indoor-side opening degree adjustment component 61*a* adjusts the opening degree of the first indoor expansion valve 5*a* on the basis of the degree of superheat or the degree of subcooling calculated by the first indoor-side determination unit 65*a*. Furthermore, the first indoor-side controller 67*a* has a microcomputer, a memory, or the like provided in order to control the first indoor unit 2*a*, and this controller is capable of exchanging control signals and the like with a remote controller (not shown) for individually operating the first indoor unit 2*a*, and of exchanging control signals and the like with the first outdoor unit 1*a* and the second outdoor unit 1*b*.

<Outdoor Units>

The first outdoor unit 1*a* and the second outdoor unit 1*b* are installed on the roof or another location in a building or the like, and are connected to the first indoor unit 2*a*, the second indoor unit 2*b*, and the third indoor unit 2*c* via the liquid refrigerant communication pipe 11 and the gas refrigerant communication pipe 12.

Next, the configuration of the first outdoor unit 1*a* will be described. The first outdoor unit 1*a* and the second outdoor unit 1*b* have the same configuration, and therefore only the configuration of the first outdoor unit 1*a* is described herein.

The first outdoor unit 1*a* primarily comprises a first compressor 8*a*, a first four-way switching valve 7*a*, a first outdoor heat exchanger 4*a*, a first outdoor expansion valve 3*a*, a first outdoor fan 9*a*, a first liquid-side shutoff valve 24*a*, a first gas-side shutoff valve 25*a*, a first outdoor heat exchange temperature sensor 22*a*, and a first outdoor heat exchange liquid-side temperature sensor 23*a*. In the first outdoor unit 1*a*, a first outdoor-side refrigerant circuit 14*a* that constitutes a part of the refrigerant circuit 10 is configured by connecting the first compressor 8*a*, the first four-way switching valve 7*a*, the first outdoor heat exchanger 4*a*, the first outdoor expansion valve 3*a*, the first liquid-side shutoff valve 24*a*, and the first gas-side shutoff valve 25*a*.

The first compressor 8*a* is a device for compressing low-pressure gas refrigerant taken in from an intake side and discharging the compressed high-pressure gas refrigerant to a discharge side. The first compressor 8*a* is a compressor whose operating capacity can be varied, and is driven by a motor controlled by an inverter.

The first four-way switching valve 7*a* is a valve for switching the direction of refrigerant flow, and during the cooling operation and the refrigerant charging operation, this valve connects the discharge side of the first compressor 8*a* with the gas side of the first outdoor heat exchanger 4*a* and connects the intake side of the first compressor 8*a* with the gas refrigerant communication pipe 12 (refer to the solid lines of the first four-way switching valve 7*a* in FIG. 1). Therefore, during the cooling operation and the refrigerant charging operation, the first outdoor heat exchanger 4*a* functions as a condenser of the refrigerant compressed in the first compressor 8*a*, and the first indoor heat exchanger 6*a*, the second indoor heat exchanger 6*b*, and the third indoor heat exchanger 6*c* function as evaporators of the refrigerant condensed in the first outdoor heat exchanger 4*a*. During the heating operation, the first four-way switching valve 7*a* connects the discharge side of the first compressor 8*a* with the gas refrigerant communication pipe 12 and connects the intake side of the first compressor 8*a* with the gas side of the first outdoor heat exchanger 4*a* (refer to the dashed lines of the first four-way switching valve 7*a* in FIG. 1). Therefore, during the heating operation, the first indoor heat exchanger 6*a*, the second indoor heat exchanger 6*b*, and the third indoor heat exchanger 6*c* function as condensers of the refrigerant compressed in the first compressor 8*a*, and the first outdoor heat exchanger 4*a* functions as an evaporator of the refrigerant condensed in the first indoor heat exchanger 6*a*, the second indoor heat exchanger 6*b*, and the third indoor heat exchanger 6*c*.

The first outdoor heat exchanger 4*a* is a cross-fin type fin-and-pipe heat exchanger configured from a heat-transfer pipe and numerous fins, and this heat exchanger functions as a refrigerant condenser during the cooling operation and as a refrigerant evaporator during the heating operation. The gas side of the first outdoor heat exchanger 4*a* is connected to the first four-way switching valve 7*a*, and the liquid side is connected to the first outdoor expansion valve 3*a*.

The first outdoor expansion valve 3*a* is an electric expansion valve connected to the liquid side of the first outdoor heat exchanger 4*a* in order to adjust the amount of refrigerant flowing through the first outdoor-side refrigerant circuit 14*a*, and to perform other functions.

The first outdoor fan 9*a* is a propeller fan disposed in proximity to the first outdoor heat exchanger 4*a* in order to supply outdoor air to the first outdoor heat exchanger 4*a*.

The first liquid-side shutoff valve 24*a* is a valve provided to the connection port between the liquid refrigerant communication pipe 11 and the first outdoor unit 1*a*. The first gas-side shutoff valve 25*a* is a valve provided to the connection port between the gas refrigerant communication pipe 12 and the first outdoor unit 1*a*. The first liquid-side shutoff valve 24*a* is connected to the first outdoor expansion valve 3*a*. The first gas-side shutoff valve 25*a* is connected to the first four-way switching valve 7*a*.

The first outdoor heat exchange temperature sensor 22*a* is provided to the first outdoor heat exchanger 4*a*, and this sensor detects the temperature of refrigerant flowing through the first outdoor heat exchanger 4*a*. The first outdoor heat exchange liquid-side temperature sensor 23*a* is provided to the liquid side of the first outdoor heat exchanger 4*a*, and this sensor detects the temperature of liquid or gas-liquid two-phase refrigerant. In the present embodiment, the first outdoor heat exchange temperature sensor 22*a* and the first outdoor heat exchange liquid-side temperature sensor 23*a* are composed of thermistors.

The first outdoor unit 1*a* also comprises a first outdoor-side controller 68*a* for controlling the various devices and valves of the first outdoor unit 1*a*, as shown in FIG. 2. The first outdoor-side controller 68*a* has a first outdoor-side determination unit 62*a* and a first outdoor-side opening degree adjustment component 64*a*. The first outdoor-side determination unit 62*a* is connected to the first outdoor heat exchange temperature sensor 22*a* and the first outdoor heat exchange liquid-side temperature sensor 23*a*, and based on the refrigerant temperature detected by the first outdoor heat exchange temperature sensor 22*a* and the first outdoor heat exchange liquid-side temperature sensor 23*a*, this determination unit calculates the degree of subcooling in the liquid side of the first outdoor heat exchanger 4*a* functioning as a condenser. The first outdoor-side opening degree adjustment component 64*a* sets as the non-target unit the outdoor unit that has the outdoor heat exchanger in which was calculated the greater degree of subcooling of the degrees of subcooling calculated by the outdoor-side determination units 62*a*, 62*b*, and sets the outdoor unit other than the non-target unit as the target unit. The first outdoor-side opening degree adjustment component 64*a* is connected to the first outdoor expansion valve 3*a*, and this adjustment component adjusts the opening degree of the first outdoor expansion valve 3*a* on the basis of the degree of subcooling calculated by the first outdoor-side determination unit 62*a*. Furthermore, the first outdoor-side controller 68*a* performs a comparison between the degree of subcooling of the non-target unit and a predetermined value set as a target value for the completion of refrigerant charging, and also performs a comparison between the target unit and the non-target unit. The first outdoor-side controller 68*a* has a microcomputer provided in order to control the first outdoor unit 1*a*, an inverter circuit for controlling the memory and motor, and other components; and can exchange control signals and the like with the first indoor-side controller 67*a*, the second indoor-side controller 67*b*, and the third indoor-side controller 67*c*.

As described above, the refrigerant circuit 10 of the air-conditioning apparatus 100 is configured by connecting the first indoor-side refrigerant circuit 13*a*, the second indoor-side refrigerant circuit 13*b*, and the third indoor-side refrigerant circuit 13*c* with the first outdoor-side refrigerant circuit 14*a* and the second outdoor-side refrigerant circuit 14*b* by refrigerant communication pipes. A main controller 60 is configured by the first indoor-side controller 67*a*, the second indoor-side controller 67*b*, the third indoor-side controller 67*c*, the first outdoor-side controller 68*a*, and the second outdoor-side controller 68*b*, as shown in FIG. 2. The main controller 60 is connected to the first four-way switching valve 7*a*, the second four-way switching valve 7*b*, the first compressor 8*a*, and the second compressor 8*b* so as to be capable of controlling these components. The main controller 60 is designed so as to perform the cooling operation and heating operation by switching the first four-way switching valve 7*a* and the second four-way switching valve 7*b*, and to control the first compressor 8*a* of the first outdoor unit 1*a*, the second compressor 8*b* of the second outdoor unit 1*b*, and other devices in accordance with the operating loads of the first indoor unit 2*a*, the second indoor unit 2*b*, and the third indoor unit 2*c*. The main controller 60 can thereby control the operation of the entire air-conditioning apparatus 100.

<Action of Air-Conditioning Apparatus>

Next, the action of the air-conditioning apparatus 100 of the present embodiment will be described.

The operation modes of the air-conditioning apparatus 100 of the present embodiment include a normal operation mode for controlling the various devices of the first outdoor unit 1*a*, the second outdoor unit 1*b*, the first indoor unit 2*a*, the second indoor unit 2*b*, and the third indoor unit 2*c* in accordance with the operating loads of the first indoor unit 2*a*, the second indoor unit 2*b*, and the third indoor unit 2*c*; and a refrigerant-charging operation mode for charging refrigerant into the refrigerant circuit 10, which is performed after the air-conditioning apparatus 100 is installed. The normal operation mode includes primarily a cooling operation and a heating operation.

The actions of the operation modes of the air-conditioning apparatus 100 are described hereinbelow.

<Normal Operation Mode>

First, the cooling operation in the normal operation mode will be described using FIG. 1.

During the cooling operation, the first four-way switching valve 7*a* and the second four-way switching valve 7*b* are in the state shown by the solid lines in FIG. 1; i.e., a state in which the discharge side of the first compressor 8*a* is connected to the gas side of the first outdoor heat exchanger 4*a* and the discharge side of the second compressor 8*b* is connected to the gas side of the second outdoor heat exchanger 4*b*, while the intake sides of the first compressor 8*a* and second compressor 8*b* are connected to the gas sides of the first indoor heat exchanger 6*a*, the second indoor heat exchanger 6*b*, and the third indoor heat exchanger 6*c*. The first outdoor expansion valve 3*a* and the second outdoor expansion valve 3*b* are in an open state, and the opening degrees of the first indoor expansion valve 5*a*, the second indoor expansion valve 5*b*, and the third indoor expansion valve 5*c* are adjusted so that the degrees of superheat of the refrigerant in the gas sides of the first indoor heat exchanger 6*a*, the second indoor heat exchanger 6*b*, and the third indoor heat exchanger 6*c* reach a predetermined value. In the present embodiment, the degrees of superheat of the refrigerant in the gas sides of the first indoor heat exchanger 6*a*, the second indoor heat exchanger 6*b*, and the third indoor heat exchanger 6*c* are detected by subtracting the refrigerant temperatures detected by the first indoor heat exchange liquid-side temperature sensor 20*a*, the second indoor heat exchange liquid-side temperature sensor 20*b*, and the third indoor heat exchange liquid-side temperature sensor 20*c* from the refrigerant temperature values detected by the first indoor heat exchange gas-side temperature sensor 21*a*, the second indoor heat exchange gas-side temperature sensor 21*b*, and the third indoor heat exchange gas-side temperature sensor 21*c*, respectively.

When the first compressor 8*a* and the second compressor 8*b* are started up while the refrigerant circuit 10 is in this state, low-pressure gas refrigerant is taken into the first compressor 8*a* and second compressor 8*b* and compressed into high-pressure gas refrigerant. This high-pressure gas refrigerant is sent to the first outdoor heat exchanger 4*a* and second outdoor heat exchanger 4*b* via the first four-way switching valve 7*a* and second four-way switching valve 7*b*, respectively. The high-pressure gas refrigerant sent to the first outdoor heat exchanger 4*a* and second outdoor heat exchanger 4*b* is subjected to heat exchange with outdoor air, and is condensed into high-pressure liquid refrigerant.

This high-pressure liquid refrigerant is sent to the first indoor unit 2*a*, the second indoor unit 2*b*, and the third indoor unit 2*c* via the first outdoor expansion valve 3*a* and the second outdoor expansion valve 3*b*. The high-pressure liquid refrigerant sent to the first indoor unit 2*a*, the second indoor unit 2*b*, and the third indoor unit 2*c* is depressurized by the first indoor expansion valve 5*a*, the second indoor expansion valve 5*b*, and the third indoor expansion valve 5*c*, resulting in low-pressure gas-liquid two-phase refrigerant, which is sent to the first indoor heat exchanger 6*a*, the second indoor heat exchanger 6*b*, and the third indoor heat exchanger 6*c*. The refrigerant is subjected to heat exchange with indoor air in the first indoor heat exchanger 6*a*, the second indoor heat exchanger 6*b*, and the third indoor heat exchanger 6*c*, and is evaporated to form low-pressure gas refrigerant. The first indoor expansion valve 5*a*, the second indoor expansion valve 5*b*, and the third indoor expansion valve 5*c* control the amount of refrigerant flowing through the first indoor heat exchanger 6*a*, the second indoor heat exchanger 6*b*, and the third indoor heat exchanger 6*c* so that the degrees of superheat in the gas sides of the first indoor heat exchanger 6*a*, the second indoor heat exchanger 6*b*, and the third indoor heat exchanger 6*c* reach a predetermined value. This low-pressure gas refrigerant is sent to the first outdoor unit 1*a* and the second outdoor unit 1*b* via the gas refrigerant communication pipe 12, and is taken back into the first compressor 8*a* and the second compressor 8*b* via the first four-way switching valve 7*a* and the second four-way switching valve 7*b*, respectively.

Next, the heating operation in the normal operation mode will be described.

During the heating operation, the first four-way switching valve 7*a* and the second four-way switching valve 7*b* are in the state shown by the dashed lines in FIG. 1; i.e., a state in which the discharge sides of the first compressor 8*a* and second compressor 8*b* are connected to the gas sides of the first indoor heat exchanger 6*a*, the second indoor heat exchanger 6*b*, and the third indoor heat exchanger 6*c*, and the intake sides of the first compressor 8*a* and second compressor 8*b* are connected to the gas sides of the first outdoor heat exchanger 4*a* and second outdoor heat exchanger 4*b*, respectively. The first outdoor expansion valve 3*a* and the second outdoor expansion valve 3*b* are in an open state, and the opening degrees of the first indoor expansion valve 5*a*, the second indoor expansion valve 5*b*, and the third indoor expansion valve 5*c* are adjusted so that the degrees of subcooling of the refrigerant in the liquid sides of the first indoor heat exchanger 6*a*, the second indoor heat exchanger 6*b*, and the third indoor heat exchanger 6*c* reach a predetermined value. In the present embodiment, the degrees of subcooling of the refrigerant in the liquid sides of the first indoor heat exchanger 6*a*, the second indoor heat exchanger 6*b*, and the third indoor heat exchanger 6*c* are detected by subtracting the refrigerant temperatures detected by the first indoor heat exchange liquid-side temperature sensor 20*a*, the second indoor heat exchange liquid-side temperature sensor 20*b*, and the third indoor heat exchange liquid-side temperature sensor 20*c* from the refrigerant temperatures detected by the first indoor heat exchange temperature sensor 26*a*, the second indoor heat exchange temperature sensor 26*b*, and the third indoor heat exchange temperature sensor 26*c*, respectively.

When the first compressor 8*a* and the second compressor 8*b* are started up while the refrigerant circuit 10 is in this state, low-pressure gas refrigerant is taken into the first compressor 8*a* and the second compressor 8*b* and compressed into high-pressure gas refrigerant, which is sent to the first indoor unit 2*a*, the second indoor unit 2*b*, and the third indoor unit 2*c* via the first four-way switching valve 7*a* and the second four-way switching valve 7*b*.

The high-pressure gas refrigerant sent to the first indoor unit 2*a*, the second indoor unit 2*b*, and the third indoor unit 2*c* exchanges heat with indoor air and condensed in the first indoor heat exchanger 6*a*, the second indoor heat exchanger 6*b*, and the third indoor heat exchanger 6*c*, forming high-pressure liquid refrigerant, which is then depressurized by the first indoor expansion valve 5*a*, the second indoor expansion valve 5*b*, and the third indoor expansion valve 5*c*, forming low-pressure gas-liquid two-phase refrigerant. The first indoor expansion valve 5*a*, the second indoor expansion valve 5*b*, and the third indoor expansion valve 5*c* control the respective amounts of refrigerant flowing through the first indoor heat exchanger 6*a*, the second indoor heat exchanger 6*b*, and the third indoor heat exchanger 6*c* so that the degrees of subcooling in the liquid sides of the first indoor heat exchanger 6*a*, the second indoor heat exchanger 6*b*, and the third indoor heat exchanger 6*c* reach a predetermined value. This low-pressure gas-liquid two-phase refrigerant is sent to the first outdoor unit 1*a* and the second outdoor unit 1*b* via the liquid refrigerant communication pipe 11. The low-pressure gas-liquid two-phase refrigerant sent to the first outdoor unit 1*a* and the second outdoor unit 1*b* is sent respectively to the first outdoor heat exchanger 4*a* and the second outdoor heat exchanger 4*b*, and subjected to heat exchange with outdoor air and condensed into low-pressure gas refrigerant, which is taken back into the first compressor 8*a* and the second compressor 8*b* via the first four-way switching valve 7*a* and the second four-way switching valve 7*b*, respectively.

Thus, when the normal operation mode is performed in the air-conditioning apparatus 100, amounts of refrigerant flow respectively to the first indoor heat exchanger 6*a*, the second indoor heat exchanger 6*b*, and the third indoor heat exchanger 6*c*; the amounts of refrigerant corresponding to the operating loads required in the air-conditioned spaces in which the first indoor unit 2*a*, the second indoor unit 2*b*, and the third indoor unit 2*c* are installed.

<Refrigerant-Charging Operation Mode>

Next, the refrigerant-charging operation mode will be described using FIGS. 1, 2, 3, 4, and 5.

In the present embodiment, an example is described in which the first indoor unit 2*a*, the second indoor unit 2*b*, and the third indoor unit 2*c*, as well as the first outdoor unit 1*a* and the second outdoor unit 1*b* which are charged in advance with predetermined amounts of refrigerant, are installed at the installation site; and the first indoor unit 2*a*, the second indoor unit 2*b*, and the third indoor unit 2*c* are connected with the first outdoor unit 1*a* and the second outdoor unit 1*b* via the liquid refrigerant communication pipe 11 and the gas refrigerant communication pipe 12, constituting the refrigerant circuit 10. An additional amount of refrigerant that was insufficient according to the lengths of the liquid refrigerant communication pipe 11 and the gas refrigerant communication pipe 12 is then charged into the refrigerant circuit 10. The process of step S1 through step S3 in the refrigerant charging operation described hereinafter is hereinbelow referred to as the refrigerant-charging initiation operation, the process of step S4 through step S8 is referred to as the refrigerant stabilizing operation, and the process of step S9 through step S14 is referred to as the refrigerant-charging completion operation.

First, an operator performing the refrigerant charging opens the first liquid-side shutoff valve 24*a* and the second liquid-side shutoff valve 24*b* as well as the first gas-side shutoff valve 25*a* and the second gas-side shutoff valve 25*b* of the first outdoor unit 1*a* and the second outdoor unit 1*b* respectively, and fills the refrigerant circuit 10 with the refrigerant that had been charged in advance into the first outdoor unit 1*a* and the second outdoor unit 1*b*.

Figure 3:
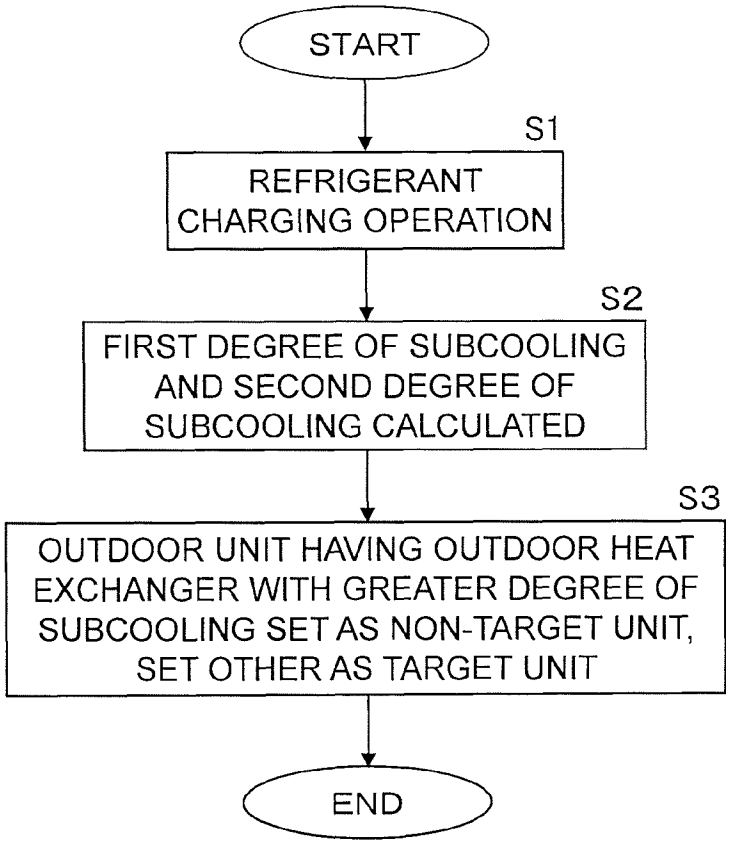
FIG. 3 is a flowchart of the refrigerant-charging initiation operation in the air-conditioning apparatus according to an embodiment of the present invention.

Next, the operator performing the refrigerant charging connects a charge port installed near the first gas-side shutoff valve 25*a* with a cylinder (not shown) in which refrigerant is sealed, using a charging pipe provided with a charging valve. When the operator performing the refrigerant charging then issues a refrigerant charging operation command to initiate the refrigerant charging, either directly to the main controller 60 or remotely via a remote controller or the like, the process of step S1 shown in FIG. 3 is performed by the main controller 60.

When an initiation command for the refrigerant charging operation is issued, the first four-way switching valve 7*a* and the second four-way switching valve 7*b* in the first outdoor unit 1*a* and the second outdoor unit 1*b* are set to the state shown by the solid lines in FIG. 1, the first outdoor expansion valve 3*a* and the second outdoor expansion valve 3*b* are both set to an open state, and the first indoor expansion valve 5*a*, the second indoor expansion valve 5*b*, and the third indoor expansion valve 5*c* of the first indoor unit 2*a*, the second indoor unit 2*b*, and the third indoor unit 2*c* are all set to an open state. When the first compressor 8*a* and the second compressor 8*b* are started up during this state of the refrigerant circuit 10, this forces the cooling operation to be performed. The refrigerant already charged into the refrigerant circuit 10 can be stabilized by performing the cooling operation for a predetermined amount of time. After a predetermined amount of time has elapsed since the performing of the cooling operation, the charging valve is set to an open state while the cooling operation continues to be performed, and refrigerant is supplied from the cylinder into the refrigerant circuit 10. The refrigerant charging operation is thereby initiated.

In the refrigerant circuit 10 at this time, high-pressure gas refrigerant compressed in the first compressor 8*a* and the second compressor 8*b* and discharged then flows through the flow passages running from the first compressor 8*a* and the second compressor 8*b* to the first outdoor heat exchanger 4*a* and the second outdoor heat exchanger 4*b* functioning as condensers; high-pressure refrigerant changing from a gas phase state to a liquid phase state through heat exchange with outdoor air flows into the first outdoor heat exchanger 4*a* and the second outdoor heat exchanger 4*b* functioning as condensers; high-pressure liquid refrigerant flows through flow passages running from the first outdoor heat exchanger 4*a* and the second outdoor heat exchanger 4*b* to the first indoor expansion valve 5*a*, the second indoor expansion valve 5*b*, and the third indoor expansion valve 5*c*, which includes the liquid refrigerant communication pipe 11 via the first outdoor expansion valve 3*a* and the second outdoor expansion valve 3*b*; low-pressure refrigerant changing from a gas-liquid two-phase state to a gas phase state through heat exchange with indoor air flows into the first indoor heat exchanger 6*a*, the second indoor heat exchanger 6*b*, and the third indoor heat exchanger 6*c* functioning as evaporators; and low-pressure gas refrigerant flows through flow passages running from the first indoor heat exchanger 6*a*, the second indoor heat exchanger 6*b*, and the third indoor heat exchanger 6*c* to the first compressor 8*a* and the second compressor 8*b*, and also including the gas refrigerant communication pipe 12. At this time, indoor-side opening degree adjustment components 67*a*, 67*b*, 67*c* adjust the respective opening degrees of the first indoor expansion valve 5*a*, the second indoor expansion valve 5*b*, and the third indoor expansion valve 5*c* so that each of the degrees of superheat of the refrigerant in the gas sides of the first indoor heat exchanger 6*a*, the second indoor heat exchanger 6*b*, and the third indoor heat exchanger 6*c* functioning as evaporators reach a predetermined value. The first outdoor-side determination unit 62*a* calculates a first degree of subcooling as the subcooling degree of the refrigerant in the liquid side of the first outdoor heat exchanger 4*a* functioning as a condenser, and the second outdoor-side determination unit 62*b* calculates a second degree of subcooling as the subcooling degree of the refrigerant in the liquid side of the second outdoor heat exchanger 4*b* (step S2). Then, the outdoor unit having the outdoor heat exchanger that has the greater degree of subcooling of either the first degree of subcooling or the second degree of subcooling calculated in the first outdoor-side determination unit 62*a* and the second outdoor-side determination unit 62*b* is set as a non-target heat exchanger, and the other is set as the target heat exchanger (step S3). The refrigerant-charging initiation operation is thereby completed.

Figure 4:
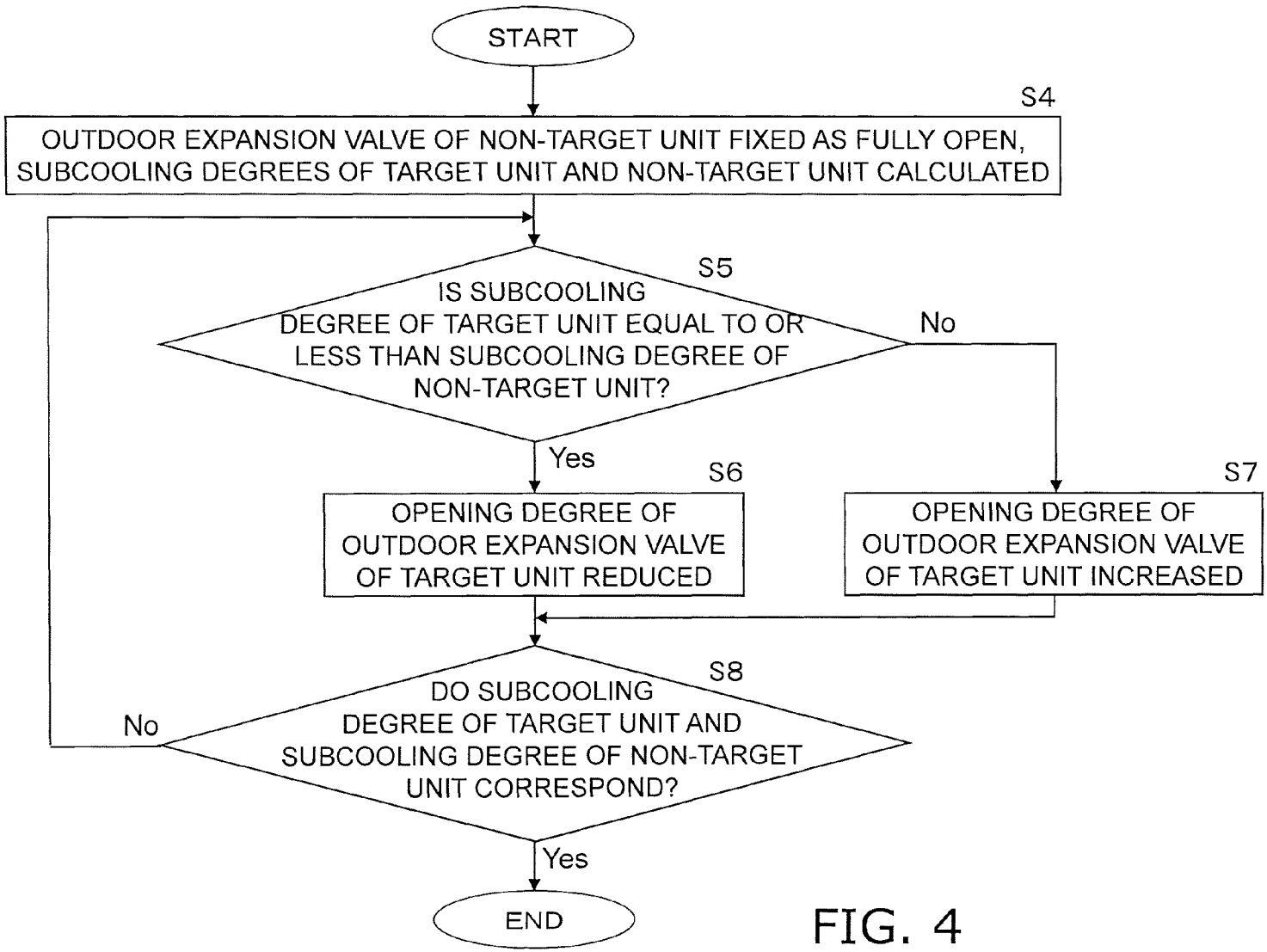
FIG. 4 is a flowchart of the refrigerant stabilizing operation in the air-conditioning apparatus according to an embodiment of the present invention.

When the refrigerant-charging initiation operation is completed, the opening degree of the outdoor expansion valve of the non-target unit is fixed in a fully open state, and each of the degrees of subcooling of the target unit and the non-target unit are recalculated, as shown in FIG. 4 (step S4). The recalculated subcooling degree of the target unit and the recalculated subcooling degree of the non-target unit are compared (step S5). In cases in which the subcooling degree of the target unit is equal to or less than the subcooling degree of the non-target unit, the opening degree of the outdoor expansion valve of the target unit is reduced (step S6). In cases in which the subcooling degree of the target unit is greater than the subcooling degree of the non-target unit, the opening degree of the outdoor expansion valve of the target unit is increased (step S7). After the opening degree of the outdoor expansion valve of the target unit has been adjusted, the subcooling degree of the target unit and the subcooling degree of the non-target unit are recalculated, and each of the degrees of subcooling are compared (step S8). At this time, in cases in which the degrees of subcooling correspond to each other, the refrigerant stabilizing operation is completed. In cases in which the degrees of subcooling do not correspond respectively, the process moves to step S5, and the degrees of subcooling of the target unit and the non-target unit are compared. Note that this refrigerant stabilizing operation is performed in parallel with a refrigerant-charging completion operation which is described hereinbelow.

Figure 5:
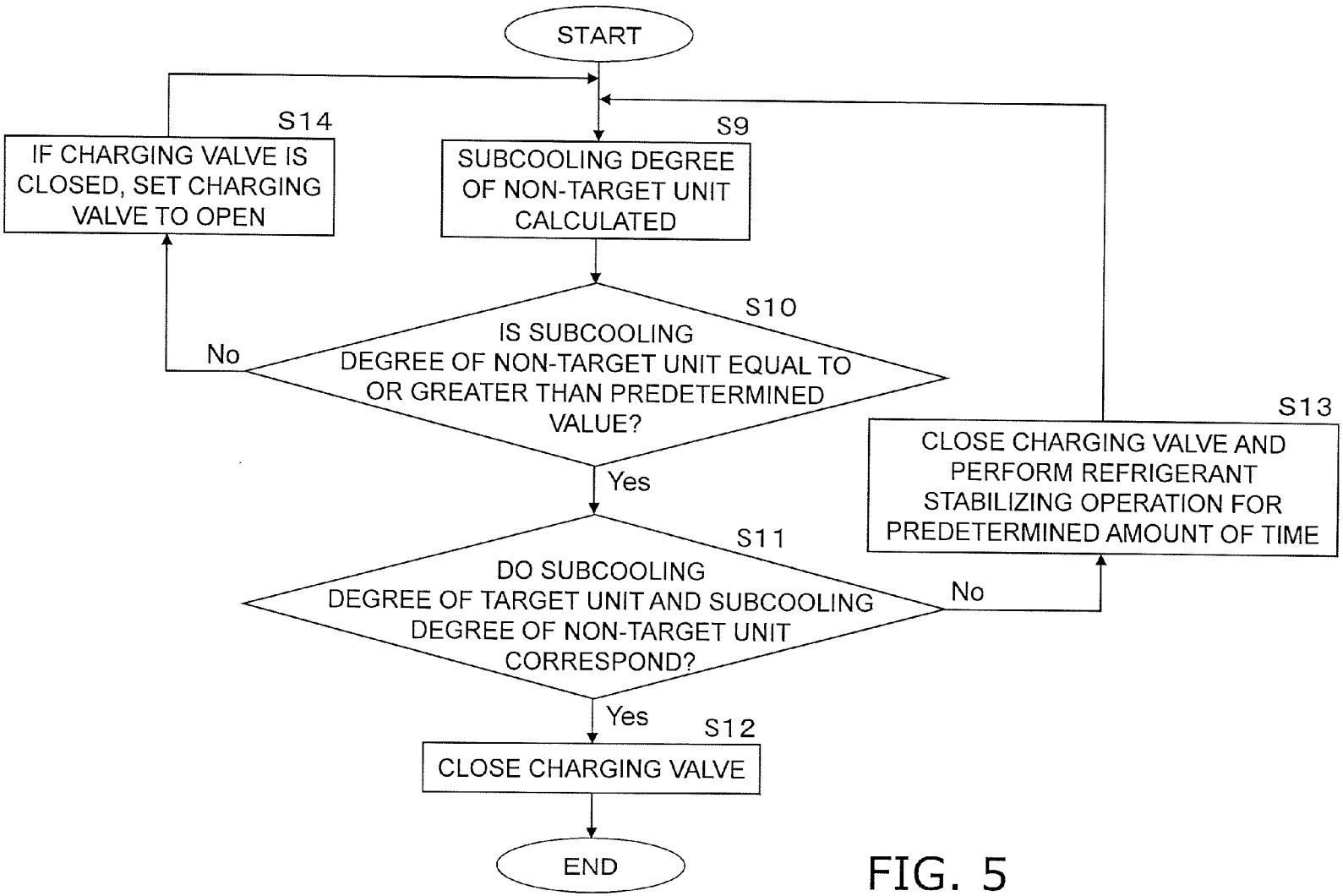
FIG. 5 is a flowchart of the refrigerant-charging completion operation in the air-conditioning apparatus according to an embodiment of the present invention.

After the refrigerant stabilizing operation has been performed for a predetermined amount of time, the subcooling degree of the non-target unit is recalculated as shown in FIG. 5 (step S9). A comparison is made between the subcooling degree of the non-target unit calculated at this time and a predetermined value set as a target value for refrigerant charging completion (step S10). In cases in which the subcooling degree of the non-target unit at this time is equal to or greater than the predetermined value, the subcooling degree of the non-target unit and the subcooling degree of the target unit are compared (step S11). In cases in which the compared degrees of subcooling correspond to each other, the charging valve is set to a closed state, and the supply of refrigerant from the cylinder is stopped (step S12). The refrigerant-charging completion operation is thereby completed. Therefore, the refrigerant charging operation is completed. When the subcooling degree of the non-target unit and the subcooling degree of the target unit are compared in step S11, the charging valve is set to the closed state and the supply of refrigerant from the cylinder is stopped also in cases in which the degrees of subcooling do not correspond to each other. The refrigerant stabilizing operation is then performed for a predetermined amount of time in a state in which the supply of refrigerant from the cylinder has been stopped (step S13). After the refrigerant stabilizing operation has been performed for a predetermined amount of time, the process moves to step S9, the subcooling degree of the non-target unit is calculated, and a comparison is made between the non-target unit and the predetermined value (step S10). At this time, in cases in which the subcooling degree of the non-target unit is not equal to or greater than the predetermined value, the charging valve is set to an open state and the supply of refrigerant from the cylinder is restarted (step S14). Note that in the present embodiment, step S8 and step S11 are performed until the subcooling degree of the target unit and the subcooling degree of the non-target unit correspond, but these steps may also be performed until both degrees of subcooling enter a predetermined range.

<Characteristics>

(1)

In conventional practice, there are air-conditioning apparatuses comprising one outdoor unit wherein the outdoor heat exchanger is caused to function as a condenser when the refrigerant circuit is charged with refrigerant, the subcooling degree of the refrigerant in the liquid side of the outdoor heat exchanger is detected, and the amount of refrigerant charged into the refrigerant circuit is determined by the degree of subcooling.

However, when the refrigerant circuit is charged with refrigerant in an air-conditioning apparatus comprising a plurality of outdoor units, there are occasions in which the refrigerant drifts due to the installation conditions of each of the outdoor units, the temperature conditions, and other conditions; and each of the degrees of subcooling in each of the outdoor heat exchangers become disproportionate. Therefore, when the amount of refrigerant charged in the refrigerant circuit is determined according to the degrees of subcooling of the refrigerant in the liquid sides of the outdoor heat exchangers, there is a danger of reducing the accuracy of this determination.

To overcome this problem, in the embodiment described above, a first outdoor-side opening degree adjustment component 64*a* and a second outdoor-side opening degree adjustment component 64*b* are provided for controlling the first outdoor expansion valve 3*a* and the second outdoor expansion valve 3*b*. During the refrigerant-charging initiation operation, the first outdoor-side opening degree adjustment component 64*a* and the second outdoor-side opening degree adjustment component 64*b* set as a non-target unit the outdoor unit having the outdoor heat exchanger whose degree of subcooling is the greater of either the calculated first degree of subcooling or the second degree of subcooling, and the other outdoor unit is set as the target unit (step S3). During the refrigerant stabilizing operation, the first outdoor-side opening degree adjustment component 64*a* and the second outdoor-side opening degree adjustment component 64*b* fix the opening degree of the outdoor expansion valve of the non-target unit in a fully open state, and adjust the opening degree of the outdoor expansion valve of the target unit (step S4 to step S7). Therefore, the degrees of subcooling of the target unit and non-target unit come to be equal. Consequently, the refrigerant does not readily drift in the outdoor heat exchanger of the target unit and in the outdoor heat exchanger of the non-target unit.

It is thereby possible to improve the precision of determining the amount of refrigerant charged into the refrigerant circuit 10 when refrigerant is charged into the refrigerant circuit 10.

(2)

In the embodiment described above, the first outdoor heat exchange liquid-side temperature sensor 23*a* and the first outdoor heat exchange temperature sensor 22*a* are provided in order to calculate the first degree of subcooling of the refrigerant in the liquid side of the first outdoor heat exchanger 4*a*, and the second outdoor heat exchange liquid-side temperature sensor 23*b* and the second outdoor heat exchange temperature sensor 22*b* are provided respectively in order to calculate the second degree of subcooling of the refrigerant in the liquid side of the second outdoor heat exchanger 4*b*. Therefore, the first outdoor-side determination unit 62*a* and the second outdoor-side determination unit 62*b* can calculate the first degree of subcooling and the second degree of subcooling according to the temperature of the refrigerant.

The degree of subcooling can thereby be determined by a simple configuration in the air-conditioning apparatus 100.

(3)

In the embodiment described above, when the refrigerant charging operation is being performed, the opening degrees of the first indoor expansion valve 5*a*, the second indoor expansion valve 5*b*, and the third indoor expansion valve 5*c* are adjusted respectively based on each of the degrees of superheat in the gas sides of the first indoor heat exchanger 6*a*, the second indoor heat exchanger 6*b*, and the third indoor heat exchanger 6*c*. Therefore, the amounts of refrigerant flowing to the first indoor heat exchanger 6*a*, the second indoor heat exchanger 6*b*, and the third indoor heat exchanger 6*c* can be respectively adjusted. Consequently, the amounts of refrigerant flowing through the first indoor heat exchanger 6*a*, the second indoor heat exchanger 6*b*, and the third indoor heat exchanger 6*c* can be kept constant.

It is thereby possible to improve the precision of determining the amount of refrigerant charged into the refrigerant circuit 10 when refrigerant is charged into the refrigerant circuit 10.

<Modifications>

(A)

Figure 6:
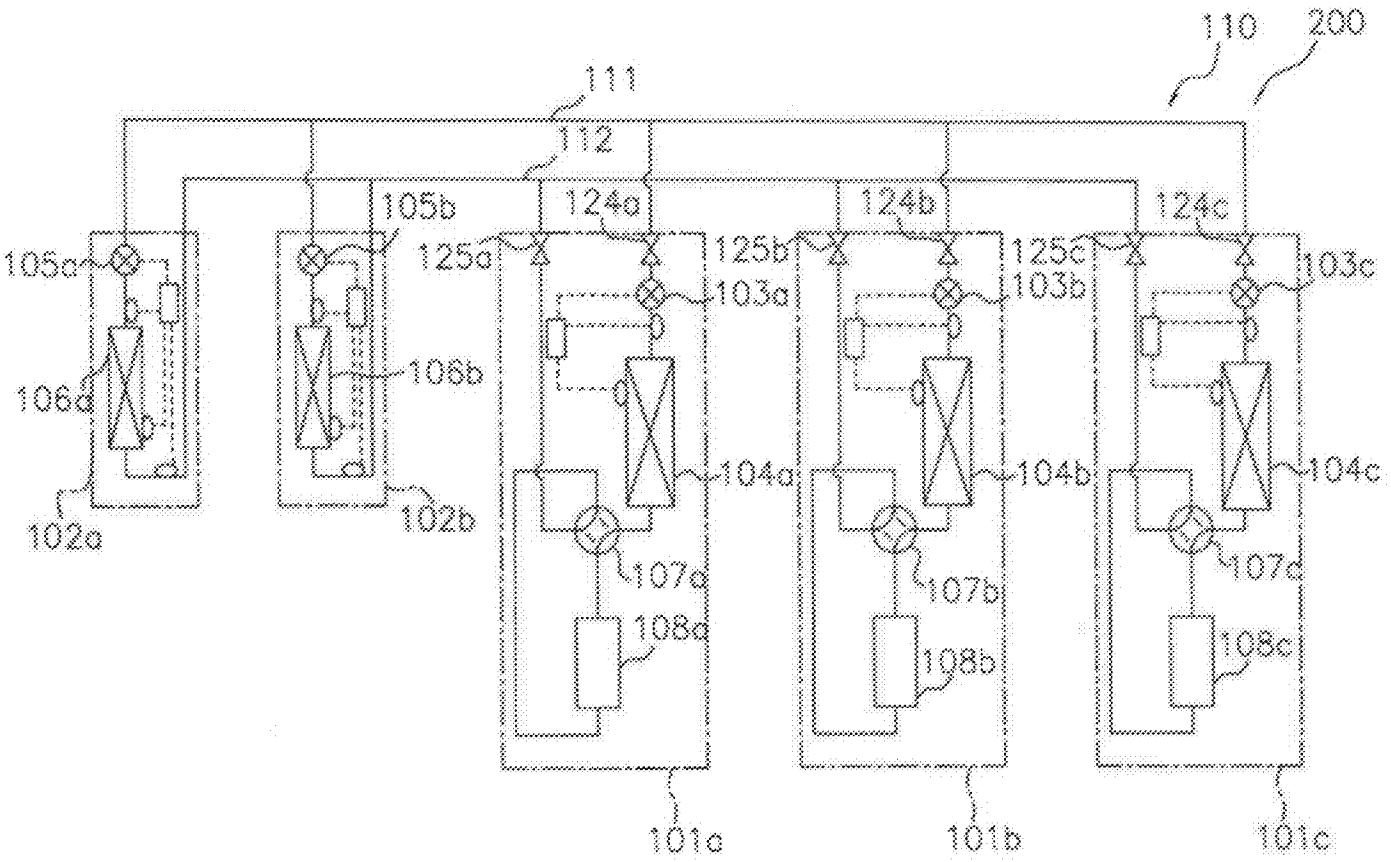
FIG. 6 is a schematic diagram of a refrigerant circuit of the air-conditioning apparatus according to Modification (A) of the present invention.
Figure 7:
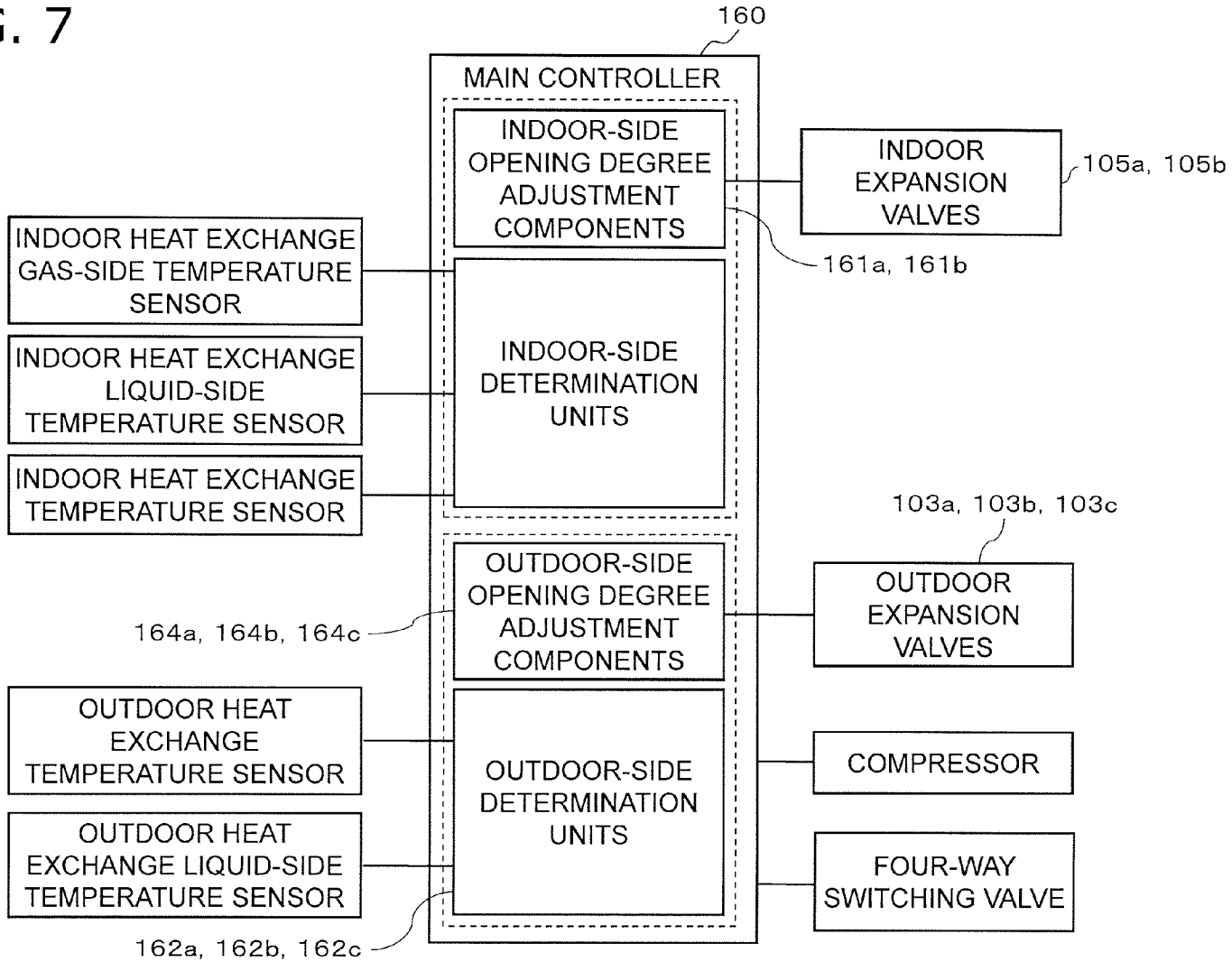
FIG. 7 is a control block diagram of the air-conditioning apparatus according to Modification (A) of the present invention.

In the embodiment described above, the air-conditioning apparatus 100 comprises two outdoor units, but may also comprise three or more outdoor units. For example, FIG. 6 is used to describe a configuration of an air-conditioning apparatus 200 comprising three outdoor units 101*a*, 101*b*, 101*c*, two indoor units 102*a*, 102*b* connected in parallel to the outdoor units 101*a*, 101*b*, 101*c*, and refrigerant communication pipes for connecting the outdoor units 101*a*, 101*b*, 101*c* with the indoor units 102*a*, 102*b*. The refrigerant communication pipes are configured from a liquid refrigerant communication pipe 111 and a gas refrigerant communication pipe 112.

The refrigerant-charging operation mode in the air-conditioning apparatus 200 is described hereinbelow using FIGS. 6, 7, 8, 9, and 10.

In the present embodiment, an example is described in which, similar to the embodiment described above, the first indoor unit 102*a*, the second indoor unit 102*b*, and the first outdoor unit 101*a*, the second outdoor unit 101*b*, and the third outdoor unit 101*c* charged in advance with predetermined amounts of refrigerant are installed at an installation site, and the liquid refrigerant communication pipe 111 and the gas refrigerant communication pipe 112 are connected, constituting a refrigerant circuit 110. An additional amount of refrigerant, which is needed according to the lengths of the liquid refrigerant communication pipe 111 and the gas refrigerant communication pipe 112, is then charged into the refrigerant circuit 110. In the refrigerant charging operation described hereinafter, steps S31 through S33 are hereinbelow referred to as the refrigerant-charging initiation operation, steps S34 through S41 are referred to as the refrigerant stabilizing operation, and steps S42 through S47 are referred to as the refrigerant-charging completion operation.

First, an operator performing the refrigerant charging opens a first liquid-side shutoff valve 124*a*, a second liquid-side shutoff valve 124*b*, and a third liquid-side shutoff valve 124*c*, as well as a first gas-side shutoff valve 125*a*, a second gas-side shutoff valve 125*b*, and a third gas-side shutoff valve 125*c* of the first outdoor unit 101*a*, the second outdoor unit 101*b*, and the third outdoor unit 101*c* respectively; and fills the refrigerant circuit 110 with the refrigerant that had been charged in advance into the first outdoor unit 101*a*, the second outdoor unit 101*b*, and the third outdoor unit 101*c*.

Figure 8:
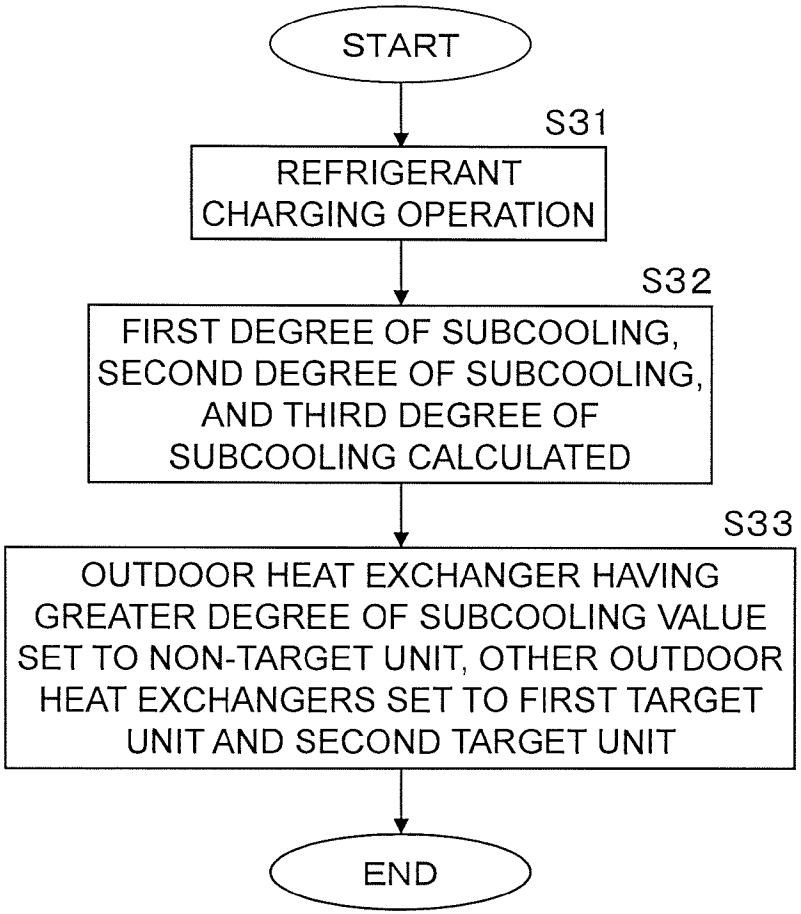
FIG. 8 is a flowchart of the refrigerant-charging initiation operation in the air-conditioning apparatus according to Modification (A) of the present invention.

Next, the operator performing the refrigerant charging connects a charge port installed near the first gas-side shutoff valve 125*a* with a cylinder (not shown) in which refrigerant is sealed, using a charging pipe provided with a charging valve. When the operator performing the refrigerant charging then issues a refrigerant charging operation command to initiate the refrigerant charging, either directly to a main controller 160 or remotely via a remote controller or the like, the process of step S31 shown in FIG. 8 is performed by the main controller 160.

When an initiation command for the refrigerant charging operation is issued, a first four-way switching valve 107*a*, a second four-way switching valve 107*b*, and a third four-way switching valve 107*c* in the first outdoor unit 101*a*, the second outdoor unit 101*b*, and the third outdoor unit 101*c* are set to the state shown by the solid lines in FIG. 6; a first outdoor expansion valve 103*a*, a second outdoor expansion valve 103*b*, and a third outdoor expansion valve 103*c* are all set to an open state; and a first indoor expansion valve 105*a* and a second indoor expansion valve 105*b* of the first indoor unit 102*a* and the second indoor unit 102*b* are both set to an open state. When a first compressor 108*a*, a second compressor 108*b*, and a third compressor 108*c* are started up during this state of the refrigerant circuit 110, this forces the cooling operation to be performed. The refrigerant already charged into the refrigerant circuit 110 can be stabilized by performing the cooling operation for a predetermined amount of time. After a predetermined amount of time has elapsed since the performing of the cooling operation, the charging valve is set to an open state while the cooling operation continues to be performed, and refrigerant is supplied from the cylinder into the refrigerant circuit 110. The refrigerant charging operation is thereby initiated.

In the refrigerant circuit 110 at this time, high-pressure gas refrigerant compressed in the first compressor 108*a*, the second compressor 108*b*, and the third compressor 108*c* and discharged then flows through the flow passages running from the first compressor 108*a*, the second compressor 108*b*, and the third compressor 108*c* to a first outdoor heat exchanger 104*a*, a second outdoor heat exchanger 104*b*, and a third outdoor heat exchanger 104*c* functioning as condensers; high-pressure refrigerant changing from a gas phase state to a liquid phase state through heat exchange with outdoor air flows into the first outdoor heat exchanger 104*a*, the second outdoor heat exchanger 104*b*, and the third outdoor heat exchanger 104*c* functioning as condensers; high-pressure liquid refrigerant flows through flow passages running from the first outdoor heat exchanger 104*a*, the second outdoor heat exchanger 104*b*, and the third outdoor heat exchanger 104*c* to the first indoor expansion valve 105*a* and the second indoor expansion valve 105*b*, which includes the liquid refrigerant communication pipe 111 via the first outdoor expansion valve 103*a*, the second outdoor expansion valve 103*b*, and the third outdoor expansion valve 103*c*; low-pressure refrigerant changing from a gas-liquid two-phase state to a gas phase state through heat exchange with indoor air flows into a first indoor heat exchanger 106*a* and a second indoor heat exchanger 106*b* functioning as evaporators; and low-pressure gas refrigerant flows through flow passages running from the first indoor heat exchanger 106*a* and the second indoor heat exchanger 106*b* to the first compressor 108*a*, the second compressor 108*b*, and the third compressor 108*c* including the gas refrigerant communication pipe 112. At this time, each of indoor-side opening degree adjustment components 161*a*, 161*b* adjust the respective opening degrees of the first indoor expansion valve 105*a* and the second indoor expansion valve 105*b* so that each of the degrees of superheat of the refrigerant in the gas sides of the first indoor heat exchanger 106*a* and the second indoor heat exchanger 106*b* functioning as evaporators reach a predetermined value. A first outdoor-side determination unit 162*a* calculates a first degree of subcooling as the subcooling degree of the refrigerant in the liquid side of the first outdoor heat exchanger 104*a* functioning as a condenser, a second outdoor-side determination unit 162*b* calculates a second degree of subcooling as the subcooling degree of the refrigerant in the liquid side of the second outdoor heat exchanger 104*b*, and a third outdoor-side determination unit 162*c* calculates a third degree of subcooling as the subcooling degree of the refrigerant in the liquid side of the third outdoor heat exchanger 104*c* (step S32).

The outdoor unit set as the non-target unit is the outdoor unit having the outdoor heat exchanger whose degree of subcooling is calculated to be the greatest of the first degree of subcooling, the second degree of subcooling, and the third degree of subcooling calculated in the first outdoor-side determination unit 162*a*, the second outdoor-side determination unit 162*b*, and the third outdoor-side determination unit 162*c*, and the other outdoor units are set as the first target unit and the second target unit (step S33). The refrigerant-charging initiation operation is thereby completed.

Figure 9:
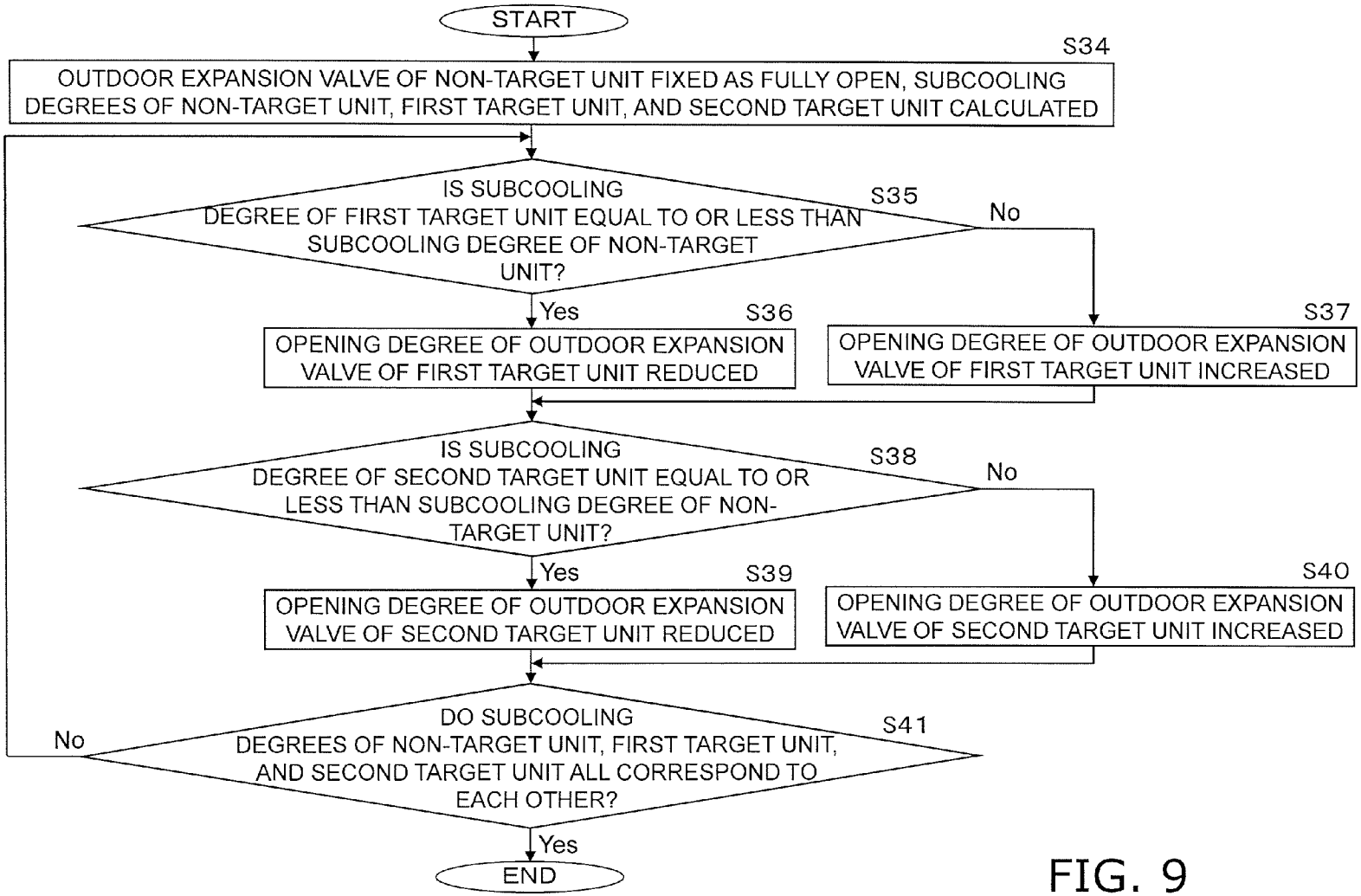
FIG. 9 is a flowchart of the refrigerant stabilizing operation in the air-conditioning apparatus according to Modification (A) of the present invention.

When the refrigerant charging operation is completed, the opening degree of the outdoor expansion valve of the non-target unit is fixed in a fully open state, and the degrees of subcooling of the non-target unit, the first target unit, and the second target unit are recalculated respectively, as shown in FIG. 9 (step S34). The recalculated subcooling degree of the first target unit and the recalculated subcooling degree of the non-target unit are compared (step S35). In cases in which the subcooling degree of the first target unit is equal to or less than the subcooling degree of the non-target unit, the opening degree of the outdoor expansion valve of the first target unit is reduced (step S36). In cases in which the subcooling degree of the first target unit is greater than the subcooling degree of the non-target unit, the opening degree of the outdoor expansion valve of the first target unit is increased (step S37). After the opening degree of the outdoor expansion valve of the first target unit has been adjusted, the subcooling degree of the second target unit and the subcooling degree of the non-target unit calculated in step S34 are compared (step S38). In cases in which the subcooling degree of the second target unit is equal to or less than the subcooling degree of the non-target unit, the opening degree of the outdoor expansion valve of the second target unit is reduced (step S39). In cases in which the subcooling degree of the second target unit is greater than the subcooling degree of the non-target unit, the opening degree of the outdoor expansion valve of the second target unit is increased (step S40). After the opening degrees of each of the outdoor expansion valves of the first target unit and the second target unit have been adjusted, the subcooling degree of the non-target unit, the subcooling degree of the first target unit, and the subcooling degree of the second target unit are recalculated, and a determination is made as to whether or not the degrees of subcooling correspond to each other (step S41). At this time, in cases in which the degrees of subcooling correspond respectively, the refrigerant stabilizing operation is completed (step S8). In cases in which the degrees of subcooling do not correspond to each other, the process moves to step S35, and the degrees of subcooling of the first target unit and the non-target unit are compared again. Note that this refrigerant stabilizing operation is performed in parallel with the refrigerant-charging completion operation which is described hereinbelow.

Figure 10:
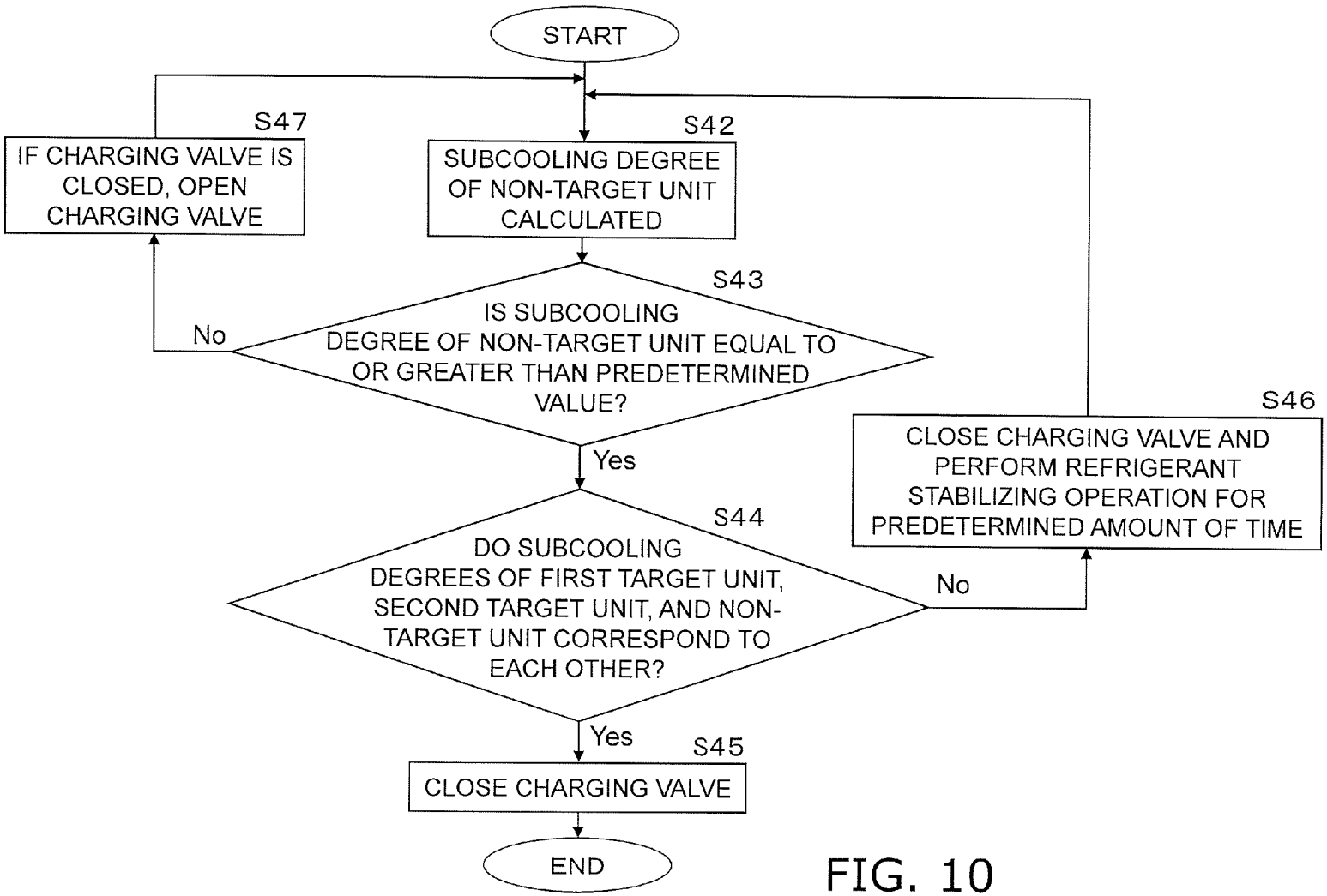
FIG. 10 is a flowchart of the refrigerant-charging completion operation in the air-conditioning apparatus according to Modification (A) of the present invention.

After the refrigerant stabilizing operation has been performed for a predetermined amount of time, the subcooling degree of the non-target unit is recalculated as shown in FIG. 10 (step S42). A comparison is made between the subcooling degree of the non-target unit calculated at this time and a predetermined value set as a target value for refrigerant charging completion (step S43). In cases in which the subcooling degree of the non-target unit at this time is equal to or greater than the predetermined value, the subcooling degree of the non-target unit and the subcooling degrees of the first target unit and the second target unit are compared respectively (step S44). In cases in which the compared degrees of subcooling correspond to each other, the charging valve is set to a closed state, and the supply of refrigerant from the cylinder is stopped (step S45). The refrigerant-charging completion operation is thereby completed. Therefore, the refrigerant charging operation is completed. When the degree of subcooling of the non-target unit is equal to or greater than the predetermined value and the subcooling degree of the non-target unit and the subcooling degrees of the first target unit and the second target unit are compared, the charging valve is set to the closed state and the supply of refrigerant from the cylinder is stopped also in cases in which the degrees of subcooling do not correspond to each other. The refrigerant stabilizing operation is then performed for a predetermined amount of time in a state in which the supply of refrigerant from the cylinder has been stopped (step S46). After the refrigerant stabilizing operation has been performed for a predetermined amount of time, the process moves to step S42, the degree of subcooling of the non-target unit is calculated, and a comparison is made between the non-target unit and the predetermined value (step S43). At this time, in cases in which the degree of subcooling of the non-target unit is not equal to or greater than the predetermined value, the charging valve is set to an open state and the supply of refrigerant from the cylinder is restarted (step S47). Note that in the present embodiment, step S41 and step S44 are performed until the degrees of subcooling of the non-target unit, the first target unit, and the second target unit correspond respectively, but these steps may also be performed until all degrees of subcooling enter a predetermined range.

(B)

In the embodiment described above, the outdoor-side controllers 68*a*, 68*b* determine the amount of refrigerant charged into the refrigerant circuit 10 by comparing the degree of subcooling of the non-target unit and a predetermined value. However, in this air-conditioning apparatus 100, the refrigerant stabilizing operation, which is an operation for minimizing drift in the outdoor heat exchangers 4*a*, 4*b*, is performed in parallel with the refrigerant-charging completion operation in which the amount of refrigerant charged into the refrigerant circuit 10 is determined. Therefore, the degree of subcooling of the target unit and the degree of subcooling of the non-target unit come to be equal. Consequently, the amount of refrigerant charged into the refrigerant circuit 10 may be determined by comparing the degree of subcooling of the target unit and the predetermined value.

(C)

In the embodiment described above, the opening degrees of the first outdoor expansion valve 3*a* and the second outdoor expansion valve 3*b* are adjusted based on the first degree of subcooling and the second degree of subcooling, so that the degree of subcooling of the target unit and the degree of subcooling of the non-target unit come to be equal.

Alternatively, the rotational speed of the first compressor 8*a* of the first outdoor unit 1*a* and the rotational speed of the second compressor 8*b* of the second outdoor unit 1*b* may be adjusted based on the first degree of subcooling and the second degree of subcooling so that the degree of subcooling of the target unit and the degree of subcooling of the non-target unit come to be equal. The following is a description of the operation of an air-conditioning apparatus wherein the rotational speed of the first compressor 8*a* and the rotational speed of the second compressor 8*b* are adjusted so as to reduce the difference between the degree of subcooling of the target unit and the degree of subcooling of the non-target unit during the refrigerant stabilizing operation. Note that the refrigerant-charging initiation operation and the refrigerant-charging completion operation are the same as in the embodiment described above and are therefore not described.

Figure 11:
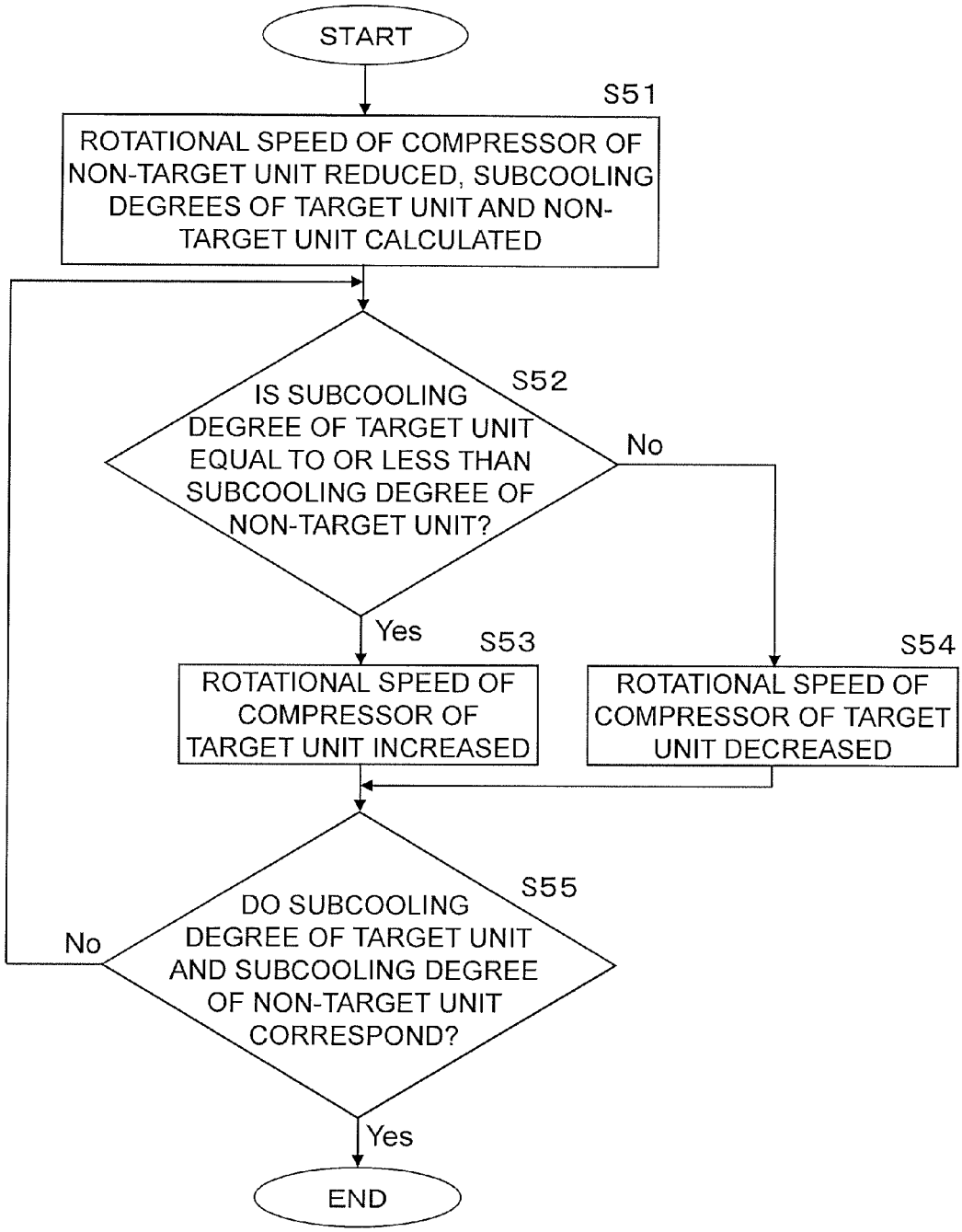
FIG. 11 is a flowchart of the refrigerant stabilizing operation in the air-conditioning apparatus according to Modification (C) of the present invention.

When the refrigerant-charging initiation operation (step S1 through step S3 in FIG. 3) is completed, the rotational speed of the compressor of the non-target unit is decreased, and the degrees of subcooling of the target unit and non-target unit are recalculated respectively as shown in FIG. 11 (step S51). The recalculated degree of subcooling of the target unit and the recalculated degree of subcooling of the non-target unit are then compared (step S52). In cases in which the degree of subcooling of the target unit is equal to or less than the degree of subcooling of the non-target unit, the rotational speed of the compressor of the target unit is increased (step S53). In cases in which the degree of subcooling of the target unit is greater than the degree of subcooling of the non-target unit, the rotational speed of the compressor of the target unit is reduced (step S54). After the rotational speed of the compressor of the target unit has been adjusted, the degree of subcooling of the target unit and the degree of subcooling of the non-target unit are recalculated, and the two degrees of subcooling are compared (step S55). In cases in which the degrees of subcooling correspond to each other at this time, the refrigerant stabilizing operation is completed. In cases in which the degrees of subcooling do not correspond to each other, the process moves to step S52, and the degrees of subcooling of the target unit and non-target unit are compared. Note that the refrigerant stabilizing operation is performed in parallel with the refrigerant-charging completion operation (step S9 through step S14 in FIG. 5).

Performing the refrigerant stabilizing operation in this manner makes it possible to reduce the difference between the flow rate of refrigerant flowing through the outdoor heat exchanger of the target unit and the flow rate of refrigerant in the outdoor heat exchanger of the non-target unit. Therefore, it is possible to inhibit refrigerant drift in the outdoor heat exchanger of the target unit and the outdoor heat exchanger of the non-target unit.

It is thereby possible to improve the precision of determining the amount of refrigerant charged into the refrigerant circuit when refrigerant is charged into the refrigerant circuit.

The rotational speed of the first outdoor fan 9*a* of the first outdoor unit 1*a* and the rotational speed of the second outdoor fan 9*b* of the second outdoor unit 1*b* may also be adjusted based on the first degree of subcooling and the second degree of subcooling, so that the degree of subcooling of the target unit and the degree of subcooling of the non-target unit come to be equal. The following is a description of the operation of an air-conditioning apparatus wherein the rotational speed of the first outdoor fan 9*a* and the rotational speed of the second outdoor fan 9*b* are adjusted in order to reduce the difference between the degree of subcooling of the target unit and the degree of subcooling of the non-target unit in the refrigerant stabilizing operation. Note that the refrigerant-charging initiation operation and the refrigerant-charging completion operation are the same as in the embodiment described above and are therefore not described.

Figure 12:
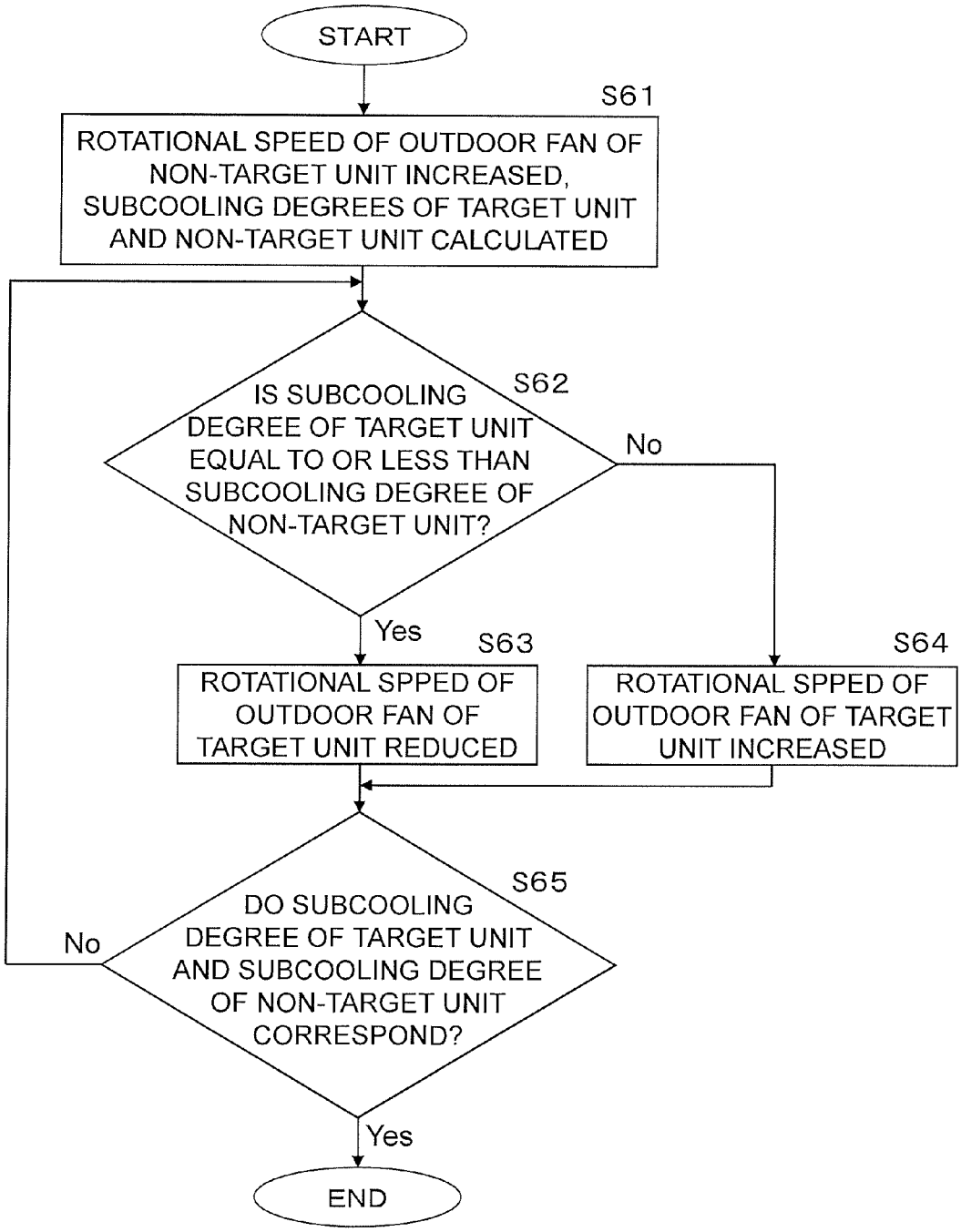
FIG. 12 is a flowchart of the refrigerant stabilizing operation in the air-conditioning apparatus according to Modification (C) of the present invention.

When the refrigerant-charging initiation operation (step S1 through step S3 in FIG. 3) is completed, the rotational speed of the outdoor fan of the non-target unit is increased, and each of the degrees of subcooling of the target unit and non-target unit are recalculated as shown in FIG. 12 (step S61). The recalculated degree of subcooling of the target unit and the recalculated degree of subcooling of the non-target unit are then compared (step S62). In cases in which the degree of subcooling of the target unit is equal to or less than the degree of subcooling of the non-target unit, the rotational speed of the outdoor fan of the target unit is reduced (step S63). In cases in which the degree of subcooling of the target unit is greater than the degree of subcooling of the non-target unit, the rotational speed of the outdoor fan of the target unit is increased (step S64). After the rotational speed of the outdoor fan of the target unit has been adjusted, the degree of subcooling of the target unit and the degree of subcooling of the non-target unit are recalculated, and the two degrees of subcooling are compared (step S65). In cases in which the degrees of subcooling correspond respectively at this time, the refrigerant stabilizing operation is completed. In cases in which the degrees of subcooling do not correspond respectively, the process moves to step S62, and the degrees of subcooling of the target unit and the non-target unit are compared. Note that this refrigerant stabilizing operation is performed in parallel with the refrigerant-charging completion operation (step S9 through step S14 in FIG. 5).

Performing the refrigerant stabilizing operation in this manner makes it possible to reduce the difference between the degree of subcooling of the target unit and the degree of subcooling of the non-target unit.

It is thereby possible to improve the precision of determining the amount of refrigerant charged into the refrigerant circuit when refrigerant is charged into the refrigerant circuit.

In the refrigerant stabilizing operation, any from a group consisting of compressor(s) adjusted by adjusting the rotational speed of the compressors, expansion valve(s) adjusted by adjusting the opening degrees of the outdoor expansion valves, and fan(s) adjusted by adjusting the rotational speeds of the outdoor fans may be combined and controlled so that the degree of subcooling of the target unit and the degree of subcooling of the non-target unit come to be equal.

INDUSTRIAL APPLICABILITY

According to the present invention, it is possible to improve the precision of determining the amount of refrigerant charged into the refrigerant circuit when refrigerant is charged into the refrigerant circuit, and the present invention is therefore effectively applied to an air-conditioning apparatus comprising a plurality of heat source units.

What is claimed is:

1. An air-conditioning apparatus comprising:

a first heat source unit having a first heat source-side heat exchanger and a first heat source-side degree of subcooling adjustment device configured to adjust a first degree of subcooling in an outlet side of the first heat source-side heat exchanger, the first heat source-side heat exchanger being operable at least as a condenser;

a second heat source unit having a second heat source-side heat exchanger and a second heat source-side degree of subcooling adjustment device configured to adjust a second degree of subcooling in an outlet side of the second heat source-side heat exchanger, the second heat source-side heat exchanger being operable at least as a condenser;

a first determination unit configured to determine the first degree of subcooling;

a second determination unit configured to determine the second degree of subcooling; and a controller configured to control the first heat source-side degree of subcooling adjustment device and the second heat source-side degree of subcooling adjustment device such that a difference between the first degree of subcooling and the second degree of subcooling is reduced when refrigerant is charged into a refrigerant circuit having the first and second heat source-side heat exchangers.

2. The air-conditioning apparatus according to claim 1, further comprising:

a first temperature sensor configured to detect temperature of refrigerant in the first heat source unit; and a second temperature sensor configured to detect temperature of refrigerant in the second heat source unit, the first determination unit being configured to determine the first degree of subcooling based on the temperature detected by the first temperature sensor, and the second determination unit being configured to determine the second degree of subcooling based on the temperature detected by the second temperature sensor.

3. The air-conditioning apparatus according to claim 1, wherein the first heat source-side degree of subcooling adjustment device includes a first heat source-side flow rate adjustment valve;

the second heat source-side degree of subcooling adjustment device includes a second heat source-side flow rate adjustment valve; and the controller is further configured to set the first heat source-side flow rate adjustment valve to a first opening degree, and set an opening degree of the second heat source-side flow rate adjustment valve to a second opening degree having a smaller opening than the first opening degree when the first degree of subcooling is greater than the second degree of subcooling.

4. The air-conditioning apparatus according to claim 1, wherein the controller is further configured to determine an amount of refrigerant in the refrigerant circuit based on either the first degree of subcooling or the second degree of subcooling.

5. The air-conditioning apparatus according to claim 1, further comprising:

a usage unit having a usage-side heat exchanger and a usage-side flow rate adjustment mechanism configured to adjust a flow rate of refrigerant flowing through the usage-side heat exchanger, the usage-side heat exchanger being operable at least as an evaporator, the usage-side heat exchanger and the usage-side flow rate adjustment mechanism being parts of the refrigerant circuit, and the controller is further configured to control the usage-side flow rate adjustment mechanism such that a degree of superheat in an outlet side of the usage-side heat exchanger reaches a predetermined value when refrigerant is charged into the refrigerant circuit.

6. An air-conditioning apparatus comprising:

first through n-th heat source units having first through n-th heat source-side heat exchangers and first through n-th heat source-side flow rate adjustment devices configured to adjust flow rate of refrigerant flowing through the first through n-th heat source-side heat exchangers, the first through n-th heat source-side heat exchangers being operable at least as a condensers;

first through n-th determination units configured to determine first through n-th degrees of subcooling in sides of the first through n-th heat source-side heat exchangers, respectively; and a controller configured to control the first through n-th heat source-side flow rate adjustment devices such that the first through n-th degrees of subcooling become equal when refrigerant is charged into a refrigerant circuit having the first through n-th heat source-side heat exchangers and the first through n-th heat source-side flow rate adjustment devices.

7. The air-conditioning apparatus according to claim 6, wherein the first through n-th heat source-side flow rate adjustment devices include first through n-th heat source-side flow rate adjustment valves, respectively; and the controller is further configured to set the first heat source-side flow rate adjustment valve to a first opening degree, and set opening degrees of the second through n-th heat source-side flow rate adjustment valves to opening degrees having smaller openings than the first opening degree when the first degree of subcooling is greater than any of the second through n-th degrees of subcooling.

8. The air-conditioning apparatus according to claim 1, wherein the first heat source-side degree of subcooling adjustment device includes a first compressor configured to compress refrigerant flowing through the refrigerant circuit;

the second heat source-side degree of subcooling adjustment device includes a second compressor configured to compress refrigerant flowing through the refrigerant circuit; and the controller is further configured to control the first compressor and the second compressor such that a rotational speed of the first compressor is less than a rotational speed of the second compressor when the first degree of subcooling is greater than the second degree of subcooling.

9. The air-conditioning apparatus according to claim 1, wherein the first heat source-side degree of subcooling adjustment device includes a first heat source-side fan configured to blow air to the first heat source-side heat exchanger;

the second heat source-side degree of subcooling adjustment device includes a second heat source-side fan configured to blow air to the second heat source-side heat exchanger; and the controller is further configured to control the first heat source-side fan and the second heat source-side fan such that a rotational speed of the first heat source-side fan is greater than a rotational speed of the second heat source-side fan when the first degree of subcooling is greater than the second degree of subcooling.

10. The air-conditioning apparatus according to claim 2, wherein the first heat source-side degree of subcooling adjustment device includes a first heat source-side flow rate adjustment valve;

the second heat source-side degree of subcooling adjustment device includes a second heat source-side flow rate adjustment valve; and the controller is further configured to set the first heat source-side flow rate adjustment valve to a first opening degree, and set an opening degree of the second heat source-side flow rate adjustment valve to a second opening degree having a smaller opening than the first opening degree when the first degree of subcooling is greater than the second degree of subcooling.

11. The air-conditioning apparatus according to claim 10, wherein the controller is further configured to determine an amount of refrigerant in the refrigerant circuit based on either the first degree of subcooling or the second degree of subcooling.

12. The air-conditioning apparatus according to claim 11, further comprising:

a usage unit having a usage-side heat exchanger and a usage-side flow rate adjustment mechanism configured to adjust a flow rate of refrigerant flowing through the usage-side heat exchanger, the usage-side heat exchanger being operable at least as an evaporator, the usage-side heat exchanger and the usage-side flow rate adjustment mechanism being parts of the refrigerant circuit, and the controller is further configured to control the usage-side flow rate adjustment mechanism such that a degree of superheat in an outlet side of the usage-side heat exchanger reaches a predetermined value when refrigerant is charged into the refrigerant circuit.

13. The air-conditioning apparatus according to claim 2, wherein the controller is further configured to determine an amount of refrigerant in the refrigerant circuit based on either the first degree of subcooling or the second degree of subcooling.

14. The air-conditioning apparatus according to claim 2, further comprising:

a usage unit having a usage-side heat exchanger and a usage-side flow rate adjustment mechanism configured to adjust a flow rate of refrigerant flowing through the usage-side heat exchanger, the usage-side heat exchanger being operable at least as an evaporator, the usage-side heat exchanger and the usage-side flow rate adjustment mechanism being parts of the refrigerant circuit, and the controller is further configured to control the usage-side flow rate adjustment mechanism such that a degree of superheat in an outlet side of the usage-side heat exchanger reaches a predetermined value when refrigerant is charged into the refrigerant circuit.

15. The air-conditioning apparatus according to claim 2, wherein the first heat source-side degree of subcooling adjustment device includes a first compressor configured to compress refrigerant flowing through the refrigerant circuit;

the second heat source-side degree of subcooling adjustment device includes a second compressor configured to compress refrigerant flowing through the refrigerant circuit, and the controller is further configured to control the first compressor and the second compressor such that a rotational speed of the first compressor is less than a rotational speed of the second compressor when the first degree of subcooling is greater than the second degree of subcooling.

16. The air-conditioning apparatus according to claim 2, wherein the first heat source-side degree of subcooling adjustment device includes a first heat source-side fan configured to blow air to the first heat source-side heat exchanger;

the second heat source-side degree of subcooling adjustment device includes a second heat source-side fan configured to blow air to the second heat source-side heat exchanger; and the controller is further configured to control the first heat source-side fan and the second heat source-side fan such that a rotational speed of the first heat source-side fan is greater than a rotational speed of the second heat source-side fan when the first degree of subcooling is greater than the second degree of subcooling.

17. The air-conditioning apparatus according to claim 3, wherein the controller is further configured to determine an amount of refrigerant in the refrigerant circuit based on either the first degree of subcooling or the second degree of subcooling.

18. The air-conditioning apparatus according to claim 17, further comprising:

a usage unit having a usage-side heat exchanger and a usage-side flow rate adjustment mechanism configured to adjust a flow rate of refrigerant flowing through the usage-side heat exchanger, the usage-side heat exchanger being operable at least as an evaporator, the usage-side heat exchanger and the usage-side flow rate adjustment mechanism being parts of the refrigerant circuit, and the controller is further configured to control the usage-side flow rate adjustment mechanism such that a degree of superheat in an outlet side of the usage-side heat exchanger reaches a predetermined value when refrigerant is charged into the refrigerant circuit.

19. The air-conditioning apparatus according to claim 3, further comprising:

a usage unit having a usage-side heat exchanger and a usage-side flow rate adjustment mechanism configured to adjust a flow rate of refrigerant flowing through the usage-side heat exchanger, the usage-side heat exchanger being operable at least as an evaporator, the usage-side heat exchanger and the usage-side flow rate adjustment mechanism being parts of the refrigerant circuit, and the controller is further configured to control the usage-side flow rate adjustment mechanism such that a degree of superheat in an outlet side of the usage-side heat exchanger reaches a predetermined value when refrigerant is charged into the refrigerant circuit.

20. The air-conditioning apparatus according to claim 4, further comprising:

a usage unit having a usage-side heat exchanger and a usage-side flow rate adjustment mechanism configured to adjust a flow rate of refrigerant flowing through the usage-side heat exchanger, the usage-side heat exchanger being operable at least as an evaporator, the usage-side heat exchanger and the usage-side flow rate adjustment mechanism being parts of the refrigerant circuit, and the controller is further configured to control the usage-side flow rate adjustment mechanism such that a degree of superheat in an outlet side of the usage-side heat exchanger reaches a predetermined value when refrigerant is charged into the refrigerant circuit.

* * * * *